US007267793B2

(12) United States Patent
Poor et al.

(10) Patent No.: US 7,267,793 B2
(45) Date of Patent: Sep. 11, 2007

(54) FURNACE FOR VACUUM CARBURIZING WITH UNSATURATED AROMATIC HYDROCARBONS

(75) Inventors: Ralph P. Poor, Toledo, OH (US); Gary W. Barbee, Rossford, OH (US); Stephen H. Verhoff, Monclova, OH (US); James E. Brug, Toledo, OH (US)

(73) Assignee: Surface Combustion, Inc., Maumee, OH (US)

( * ) Notice: Subject to any disclaimer, the term of this patent is extended or adjusted under 35 U.S.C. 154(b) by 0 days.

(21) Appl. No.: 11/404,459

(22) Filed: Apr. 14, 2006

(65) Prior Publication Data

US 2006/0180961 A1 Aug. 17, 2006

Related U.S. Application Data

(62) Division of application No. 10/205,721, filed on Jul. 26, 2002, now Pat. No. 7,033,446.

(60) Provisional application No. 60/308,454, filed on Jul. 27, 2001, provisional application No. 60/308,452, filed on Jul. 27, 2001.

(51) Int. Cl.
*C21D 1/74* (2006.01)

(52) U.S. Cl. ..... 266/250; 266/252

(58) Field of Classification Search ..... 266/250, 266/252, 257, 87; 148/216
See application file for complete search history.

(56) References Cited

U.S. PATENT DOCUMENTS 2,348,557 A 5/1944 Mattox
2,915,571 A 12/1959 Haensel
3,529,152 A 9/1970 Strange et al.

(Continued)

OTHER PUBLICATIONS

A.J. Derosset and C.V. Berger, "Thermal and catalytic Decomposition of Hydrocarbons," Universal Oil Products Co. Des Planes, IL, an I/EC Unit Process Review, Industrial and Engineering chemistry, vol. 53, No. 8, Aug. 1961, pp. 680-682.

(Continued)

*Primary Examiner*—Scott Kastler
(74) *Attorney, Agent, or Firm*—MacMillan, Sobanski & Todd, LLC

(57) ABSTRACT

Vacuum carburizing of ferrous workpieces is performed at low pressure in a vacuum furnace using an unsaturated aromatic such as benzene as the carburizing medium. The unsaturated aromatic is gas phase hydrogenated into naphthenes, such as cyclohexane, which is metered into the furnace chamber proper and functions as the carburizing gas. The furnace is constructed to be generally transparent to the naphthenes so that cracking tends to occur at the workpiece which functions as a catalyst to minimize carbon deposits. The unsaturated aromatic is supplied in liquid form to fuel injectors which inject the liquid aromatic as a vapor at duty cycles and firing orders to produce a uniform dispersion of the hydrocarbon gas about the work resulting in uniform carburizing of the workpieces. An in-situ methane infrared sensor controls the process. Excess hydrogen beyond what is required to hydrogenate the aromatic is added to the furnace chamber to either assure full carbon potential and produce methane or to perform variable carburizing. Hydrogenation occurs in a hydrogenation coil in fluid communication with the furnace chamber with temperature for the reaction set by the position of the hydrogenation coil in the furnace insulation.

29 Claims, 14 Drawing Sheets

U.S. PATENT DOCUMENTS

| | | | | |
|---|---|---|---|---|
| 3,917,238 | A | | 11/1975 | Gohring |
| 3,968,957 | A | | 7/1976 | Asai et al. |
| 4,008,394 | A | | 2/1977 | Risgin et al. |
| 4,166,610 | A | | 9/1979 | Yamazaki et al. |
| 4,191,598 | A | | 3/1980 | Conybear et al. |
| 4,232,852 | A | | 11/1980 | Limque et al. |
| 4,249,965 | A | | 2/1981 | Schultz |
| 4,386,973 | A | | 6/1983 | Kawka et al. |
| 4,783,575 | A | | 11/1988 | Schmidt et al. |
| 5,093,571 | A | | 3/1992 | Inomata et al. |
| 5,127,967 | A | | 7/1992 | Verhoff et al. |
| 5,205,873 | A | | 4/1993 | Faure et al. |
| 5,224,857 | A | | 7/1993 | Schultz et al. |
| 5,228,850 | A | | 7/1993 | Hoetzl et al. |
| 5,385,337 | A | * | 1/1995 | Schultz ..... 266/87 |
| 5,528,032 | A | | 6/1996 | Uchiyama |
| 5,593,571 | A | | 1/1997 | Heyse et al. |
| 5,702,540 | A | | 12/1997 | Kubota |
| 6,187,111 | B1 | | 2/2001 | Waka et al. |
| 6,237,575 | B1 | | 5/2001 | Lampert et al. |
| 6,258,179 | B1 | | 7/2001 | Takayama et al. |
| 6,283,749 | B1 | | 9/2001 | Bernard, Jr. et al. |
| 6,366,355 | B1 | | 4/2002 | deGroot et al. |
| 6,991,687 | B2 | | 1/2006 | Poor et al. |
| 7,033,446 | B2 | | 4/2006 | Poor et al. |

OTHER PUBLICATIONS

Michael Lohrmann and Winfried Grafen, Ipsen International GmbH, Kleve, Germany, "New Wrinkles in Low-Pressure Carburizing", Heat Treating Progress, Feb./Mar. 2001, pp. 47-51.

Piotr Kula, Institute of Material Science & Engineering, Josef Olejnik, Seco/Warwick (Poland) Ltd. Janusz Kowalski, Seco/Warwick Corp."New Vacuum Carburizing Technology," Heat Treating Progress, Feb./Mar. 2001 pp. 57-60.

K.L. Yang and R.T. Yang, "The Accelerating and Retarding Effect of Hydrogen on Carbon Deposition on Metal Surfaces", Carbon, vol. 24, pp. 687-693, Dec. 1986.

* cited by examiner

FURNACE FOR VACUUM CARBURIZING WITH UNSATURATED AROMATIC HYDROCARBONS

CROSS-REFERENCE TO RELATED APPLICATIONS

This application is a divisional application of Ser. No. 10/205,721 filed Jul. 26, 2002, now U.S. Pat. No. 7,033,446 which claims the benefit of U.S. Provisional Application No. 60/308,452, filed Jul. 27, 2001, entitled "Vacuum Carburizing by Unsaturated Aromatic Hydrocarbons" and also claims the benefit of U.S. Provisional Application No. 60/308,454, filed Jul. 27, 2001, entitled "Vacuum Carburizing by Saturated Aromatic Hydrocarbons."

This application also relates to an application, now U.S. Pat. No. 6,991,687, issued Jan. 31, 2006, entitled "Vacuum Carburizing with Naphthene Hydrocarbons" the disclosure of which is hereby incorporated herein and made a part hereof.

This invention relates generally to method and apparatus for carburizing ferrous workpieces, and more particularly to method and apparatus for vacuum carburizing ferrous workpieces.

BACKGROUND

This invention (method and apparatus) relates to carburizing ferrous articles, parts or workpieces and conceptually related processes such as carbonitriding. Carburizing may be defined as the introduction or application of additional carbon to the surface of a ferrous metal article with the object of increasing the carbon content of the surface, and to some limited depth, beneath the surface (the depth of substantive penetration of the carbon hereinafter called "case") of the article. When the article is subsequently subjected to an additional heat treatment, the surface portion carburizes resulting in a substantially harder surface than the underlying virgin or "green" metal. This is known in the art as "case hardening."

Carburizing is an old and developed process. There are a number of methodologies which have been used to carburize ferrous parts. Perhaps the earliest application is "box carburizing" where open charcoal pits were used. Bone meal was packed around the parts to provide a protective atmosphere when heated and to be the source of carbon. That process has evolved into "pack carburizing" where parts to be carburized are packed into a box with a carburizing compound, such as metal carbonates burned to a hardwood charcoal by the use of oil, tar and the like, packed thereabout. Carbon is formed on the surface of the steel by the decomposition of carbon monoxide (from the carburizing compound) into carbon and carbon dioxide. The carbon dioxide that is formed reacts immediately with the uncondensed carbon in the carburizing compound to produce fresh carbon monoxide. This process is repeated as long as there is enough carbon present to react with the excess of carbon dioxide and until the surface of the ferrous part is saturated. This "class" of carburizing is distinguished from the prior art to which this invention relates by its requirement for a solid carburizing compound "packed" about the workpiece. Another process which is used is liquid carburizing in which the steel or iron is placed in a molten salt bath that contains chemicals such as barium cyanide and the like required to produce a chafe comparable with one resulting from pack carburizing. The piece is placed in the bath for a predetermined length of time at elevated temperature such that the carbon diffuses into the surface of the metal. This "class" of carburizing is distinguished from the prior art to which this invention relates by its requirement for a liquid or salt bath into which the workpiece is submerged.

This invention generally relates to carburizing by "gas" in that a gas containing carbon is used as a gaseous medium to provide gas phase carbon atoms to iron to produce the face centered iron with carbon in the matrix as well as iron carbide ($Fe_3C$) precipitate. Gas carburizing can be further divided into atmosphere gas carburizing and vacuum carburizing with vacuum ion carburizing as a separate species of vacuum carburizing.

Atmosphere gas carburizing is a well developed technology which has proven acceptable for most case hardening carburizing applications. In atmosphere gas carburizing, a hydrocarbon, typically natural gas (methane), propane or butane, is metered into an endothermic gas furnace atmosphere maintained at positive pressure (i.e., at "atmospheric" pressure) in an industrial furnace. By controlling dew point of the gas composition (endothermic gas and carburizing gas), most typically the $CO/CO_2$ gas ratio (water gas shift reaction), the gas carbon potential is controlled. Typically, the gas carbon potential is set at or near the saturation of carbon in the iron solution and when carbon in the iron matrix and iron carbide ($Fe_3C$) precipitates are formed throughout the surface, the gas carbon potential of the furnace atmosphere gas is changed to neutral ("equilibrium carburizing") to allow the carbon to diffuse into the case. The diffusion can be controlled vis-à-vis gas composition and temperature. For example, it is possible with atmosphere gas carburizing to actually decarb (remove carbon from) the surface during diffusion to allow a harder part composition between part surface and "green" core (portion of virgin metal beneath surface not affected by carburizing) because the case depth is increasing during diffusion. Further, in atmosphere gas carburizing the carbon potential does not have to be set at saturation limits of the steel. Specifically the carbon potential can be set at lesser values to avoid a natural phenomenon occurring at saturation referred to herein as "carbide network". That is, at saturation, the surface of the part comprises iron carbides closely packed as adjacent molecules of face centered carbon steel which can be viewed as linked together in a "carbide network." When carbon diffusion occurs it is potentially possible that groups or clusters of the packed iron carbide molecules are not homogeneous throughout the case. Conventional metallurgical thinking in the trade is that over time and at high stress, the carbide network can function as a stress riser. Some metallurgists, however, do not share this opinion.

With atmosphere gas carburizing, the carbide network can be minimized by simply controlling the carbon potential to minimize the formation of the network in the first place. That is, if carburizing does not occur at saturation, the network is not likely to be formed. Atmosphere gas carburizing inherently produces metal oxides on the part surface because of the presence of oxygen in the atmosphere. For this reason, atmosphere gas carburizing is fundamentally different from vacuum gas carburizing which does not have oxygen. For this reason as well as other process considerations fundamentally arising from the use of vacuum and its affect on gas reactions, atmosphere gas carburizing is a carburizing class distinguishable from the prior art related to this invention. (Also, this invention is fundamentally different from vacuum carburizing prior art which uses oxygen. For example, see U.S. Pat. No. 4,386,973 to Kawka et al., issued Jun. 7, 1983, which discloses alcohol for use as a vacuum carburizing gas.) For closely controlled, high stress areas such as required in the aerospace industries and even for gear trains in vehicular applications, the presence of metal oxides which, among other things, produce stress risers and change part dimensions is not acceptable.

Vacuum carburizing avoids the formation of metal oxides because a hydrocarbon gas lacking oxygen is used and the furnace chamber is pumped down to a high vacuum (low pressure) to remove any oxygen that may be present. Vacuum furnaces are typically utilized for heat treating precision parts with strict case hardening specifications. In vacuum carburizing the furnace is pumped down to a vacuum and the part heated to a carburizing temperature under vacuum. The furnace is then backfilled (but still under vacuum) with a carburizing gas, typically propane or butane, which disassociates at the carburizing temperature to produce carbon molecules that go into solution with the iron and cause iron carbide as precipitate at the part surface. Because the carbon disassociation can not be controlled (the presence of vacuum and only the carburizing gas), vacuum carburizing proceeds at saturation limits (about 1.31% for carburizing plain carbon type steels at temperatures of 1700° F.) and will likely or may produce the carbide network discussed above throughout the surface. (If the carburizing hydrocarbon gas is metered at less than carbon saturation potential, uneven carburizing occurs.) Often the saturation portion of the carburizing cycle is called the "boost" portion. Metering of the carburizing gas is stopped at this point and diffusion is allowed to proceed with or without a change in temperature. (If the vacuum pump continues to run after metering of the gas is stopped, the vacuum increases and the part is subjected to strictly diffusion. As used herein, "diffusion" covers both "boost diffusion" and diffusion at a fixed or set vacuum level.)

Again, it must be noted that many metallurgists believe that vacuum diffusion (Fickes Law, Harris Law) disassociates or breaks up the iron carbide network. Others believe that the network can exist as described above. Still others believe the iron carbide network is not undesirable. In any event, carbon in solution diffuses into the case when flow of carburizing gas stops and vacuum is maintained at the carburizing temperature. The cycle may be repeated until the proper depth of carbon penetration is obtained. The carburized part is subsequently either heated to a proper hardening temperature and transferred to a quench (either a gas quench at high bar or a liquid quench which can be either under vacuum or positive pressure in the furnace) or removed from the furnace and later reheated and case hardened. Typically, the vacuum furnace is a cold wall, water cooled pressure vessel heated by electric heating elements. Recent developments in this area have included the use of gas fired radiant tubes to replace the electric resistance heating elements (see U.S. Pat. No. 5,224,857 to Schultz et al., issued Jul. 6, 1993) and the development of gas fired, hot wall vacuum carburizing furnaces (see U.S. Pat. No. 5,228,850 to Hoetzl et al., issued Jul. 20, 1993 and U.S. Pat. No. 6,283,749 to Bernard, Jr. et al., issued Sep. 4, 2001). Because of the hot wall configuration, the temperature for hardening applications may be limited in hot wall carburizing furnaces, but carburizing temperatures of 1700° F. to 1800° F. are easily obtainable.

Some limitations present in conventional vacuum furnaces relate to the ability to uniformly carburize parts having convoluted surfaces such as certain types of gears or certain parts which may be tightly packed in work baskets hindering penetration of the carburizing gases. In such applications an ion carburizing furnace has been developed which develops a cold plasma that produces a glow about the workpiece (see, for example, U.S. Pat. No. 5,127,967 to Verhoffet al., issued Jul. 7, 1992). The carburizing gas is ionized in the glow discharge producing carbon. Typically, the parts are initially cleansed by ionizing a non-carbon bearing gas, such as hydrogen, in a "sputter clean" step. During carburizing, the glow discharge produces a uniform infusion of carbon over the irregular part surface. Like conventional vacuum carburizing, vacuum ion carburizing also has iron carbide network limitations since carbon diffuses into the surface until saturation. In addition a conventional vacuum furnace has to be fitted with a power supply and electrically insulated vis-à-vis its hearth so that gas ionization can proceed. This increases the expense of the furnace.

This invention relates to gas carburizing with vacuum and prior art classified as conventional vacuum carburizing or vacuum ion carburizing is pertinent to the present invention.

Typically, the carburizing gas used in vacuum carburizing is a lower order saturated aliphatic hydrocarbon such as propane or butane while gas atmosphere carburizing typically uses the simplest alkane, methane and occasionally, propane. However, other carburizing gases have been used in vacuum carburizing. U.S. Pat. No. 5,702,540 to Kubota, issued Dec. 30, 1997, is commercialized and discloses the use of acetylene as a carburizing gas. The gas has been promoted for its ability to achieve carbon diffusion in small holes having high L/D (hole length to hole diameter) ratios when compared to processes using the typical straight chain alkanes. Because of the sooting (carbon deposit) produced by acetylene, Kubota operates the furnace chamber at high vacuum (low pressure). The concept is to draw the carburizing gas out quickly so carbon cannot deposit while the abundant supply of carbon present in the acetylene gas is still sufficient to form a saturated iron carbide at the surface of the workpiece. Thus, Kubota uses an unsaturated aliphatic gas at high vacuum (low pressure) to prevent sooting. In contrast, U.S. Pat. No. 6,187,111 to Waka et al., issued Feb. 13, 2001, uses ethylene as a carburizing gas but at a lower vacuum level (higher pressure) than Kubota. According to Waka, if the vacuum is higher (low pressure) than the minimum, carburizing cannot occur and if the vacuum is lower (less pressure) than the maximum, carbon soot will form. U.S. Pat. No. 5,205,873 to Faure et al., issued Apr. 27, 1993, also discloses the use of the unsaturated aliphatic hydrocarbon, ethylene as a carburizing gas. However, Faure introduces hydrogen in a vacuum carburizing process. After preparing the work for carburizing, Faure backfills the furnace chamber with $H_2$ to a pressure of about ½ atmosphere. Ethylene is then metered into the furnace while the chamber is pumped down to normal vacuum levels in the range of 7.5 to 75 torr. As the ethylene is pumped in, the $H_2$ is pumped out. At the same time, cracking of ethylene produces $H_2$, so some $H_2$ is made up or created. However the $H_2$ is being reduced during the process from a "high" of up to 60% at the beginning of the cycle to a "low" as little as 2% at cycle end. For reasons discussed below, while $H_2$ is beneficial to the process, Faure is opposite to what is desired.

The literature has also recognized the trend to unsaturated higher order aliphatics. See, for example, the article "New Vacuum Carburizing Technology", published in the February/March 2001 issue of Heat Treating Progress, at pages 57-60, which discusses ethylene and controlling tar deposits by introduction of hydrogen (and nitrogen) at high percentages. The article states that if hydrogen was maintained at greater than 60% of the gas composition in the furnace chamber, soot could be eliminated. For reasons discussed below, it is possible that repeatedly issues concerning the carburized case are present at the high percentages cited.

The article "New Wrinkles in Low-Pressure Carburizing", also published in the same issue of Heat Treating Progress, at pages 47-51, discusses acetylene in a plasma discharge application.

As is well known, the aliphatic hydrocarbons are divided into two groups, namely, the saturated aliphatics or alkanes or paraffins, and unsaturated aliphatics, which include both alkenes and alkynes. Alkenes are also referred to as olefins and alkynes are referred to as acetylenes. The alkenes or olefins have a carbon-carbon double bond and include compounds such as ethylene (or also called ethene) and is denoted chemically by the formula $C_2H_4$. Alkynes with the triple bond include gases or compounds like acetylene (also called ethyne) and is denoted by $C_2H_2$ or HC≡CH with triple bonds between the HC and CH molecules or carbon pairs. Alkanes include methane, ethane, propane, butane, pentane, hexane, heptane, octane, and nonane. All of the alkanes can be expressed as the formula of $C_nH_{(n*2+2)}$ In regard to the alkenes and alkynes, a different but repeating process occurs for the hydrogen to carbon relationship. The family of alkenes is expressed by the relationship of $C_nH_{2n}$. Thus, in the case of ethylene $C_2H_4$, the number of "H" is strictly double that of the "C". Also in the alkene family is propylene $C_3H_6$. The family of alkynes is expressed by the formula $C_nH_{2n-2}$. An example of this compound is acetylene $C_2H_2$.

In addition to the relationship between the hydrogen to carbon count, there is a special relationship regarding the number of bonds between the carbons. Alkanes have one bond between each C and as previously indicated, alkenes have two bonds and alkynes have three. In regard to the arrangement of the carbon hydrogens to each other, the aliphatics are characterized as "string" compounds that can be straight or branched chain. The strings are represented as HC≡CH for acetylene instead of simply $C_2H_2$. The carburizing gases thus used in vacuum furnaces prior to this invention had hydrocarbon in which the carbons were bound together in a string or chain.

The vacuum processes in the prior art discussed above have been confronted with at least two problems. The first problem is that they have only been able to supply a level of carbon at saturation or above. The high carbon potential is often rejected by many because carbide networks are typically formed which is undesirable. To combat the carbide network previous methods have removed the carbon bearing gas by evacuation or the turning off of the plasma to allow the carbide networks to diffuse away or homogenize into the steel. This approach does work, but it is not truly desirable since the carbide networks are considered bad in most cases.

As noted, when unsaturated aliphatic hydrocarbons break down during carburizing, they produce a by-product known as soot which includes tar as well as solid carbon particles. The soot collects in the furnace after the process and must be removed. This requires extra maintenance and expense to keep the operation clean and reduces productivity. The higher order hydrocarbons especially have a tendency to deposit soot. In the one article cited, high quantities of hydrogen are introduced into the furnace, which could, in theory, raise repeatability issues. In the '540 acetylene patent, high vacuum levels are required to prevent soot formations, according to the theory of that patent.

In all the vacuum technology prior art, the carburizing gas is introduced at levels sufficiently high to saturate the workpiece surface and the gas metering is stopped to allow diffusion. This results because there is no way to control the carbon potential in the vacuum environment. For gas atmosphere carburizing a $CO/CO_2$ ratio can be maintained. However, oxygen does not exist in a vacuum carburizing process and the vacuum drawn is constantly drawing out the carburizing gas.

Insofar as vacuum carburizing apparatus is concerned, all conventional apparatus meters the carburizing medium into the furnace chamber as a gas. In fact, all industrial furnace heat treat processes (other than the salt bath class) use gas, although there are one or two known instances where kerosene was dripped into a positive pressure furnace chamber (gas carburizing) or where one of the pretreatment gas pressures was inadvertently controlled so that liquid nitrogen was inadvertently injected into the furnace. Carburizing occurs immediately upon introduction of the carburizing medium into the furnace chamber and the vacuum reduces the moles of carburizing gas present in the furnace chamber. The controllability of the process is therefore a function of the sensitivity of the mass flow controller and the ability of the gas flow metering valves to meter the gas. In vacuum carburizing (and until this invention), no in-situ measurements of the gas in the furnace chamber were taken. Only one gas was used and the gas flow was set at a carbon potential to produce a saturated iron carbide surface that was subsequently diffused into the case. Where an additional gas was used (hydrogen or nitrogen for carbonitriding), that was also set at a fixed quantity. In summary, for a number of reasons, there is not believed to be any in-situ gas control of the vacuum carburizing process until this invention.

For the higher order unsaturated aliphatic hydrocarbons which are highly reactive the system that is used to pressurize and deliver the gas to the furnace can affect the composition of the gas metered into the furnace. Depending on the purity of the feedstock and the gas delivery system, variations in the hydrocarbon make-up can occur. While the fact that there may be some cracking of the hydrocarbons in the delivery system will not materially alter the carburizing process (since the HC must be cracked anyway to produce the carbon) in theory variations are possible in the gas delivered to the furnace and this relates to precise control and repeatability of the process.

For acetylene, the complications may be more severe. Acetylene in the pressurized cylinder form is supplied with acetone as one of the components. The weight of acetone settles that component to the bottom of the cylinder. As the contents of the cylinder are consumed to provide acetylene gas, the gas layer at the top of the cylinder can, in theory, carry some acetone with it. Acetone produces oxygen on decomposition which is to be avoided in vacuum carburizing. Thus, the possibility of acetone in the acetylene gas increases as the bottled acetylene tank is used up.

In the petroleum or petrochemical field, it is well known to hydrogenate aromatic hydrocarbons to naphthene. For example, it is well known to hydrogenate benzene to cyclohexane. This is typically done in a distillation process with liquids. However, gas hydrogenation is also practiced. Some general comments on the process as applied to this invention as practiced in the petroleum field is set forth in the Detailed Description below.

It is also well known that unsaturated aromatics, such as benzene, are to be avoided in the vacuum carburizing process to which this invention relates. It is well known that benzene rings combine to form an oily residue commonly known as tar.

SUMMARY OF THE INVENTION

Accordingly, it is one of the major undertakings of the present invention to provide a system (method and apparatus) which is an improvement in the art of vacuum carburizing ferrous workpieces.

This object along with other features of the invention is achieved in a method or process for vacuum carburizing which is conventional in the sense that ferrous workpieces are heated to a carburizing temperature in a cleansed furnace pressure chamber that is maintained at a vacuum while a carburizing gas within the furnace chamber disassociates to produce carbon absorbed into the surface of the workpiece to produce carbon in solution and iron carbide, $Fe_3C$. The improvement includes the steps of providing a source of an unsaturated aromatic hydrocarbon and a source of hydrogen. The unsaturated aromatic hydrocarbon is metered with a set quantity of the hydrogen to hydrogenate a substantial portion of the unsaturated aromatic into a naphthene hydrocarbon. The naphthene hydrocarbon is then metered into the furnace chamber proper as the carburizing gas along with any hydrogen not used in the hydrogenation reaction. It is believed that the stable carbon ring of naphthene in the vacuum environment of the furnace chamber minimizes carbon soot forming deposits while the ferrous surfaces of the workpiece function as a known catalyst to speed the cracking of the ring hydrocarbon so that the carbon in the naphthene molecules can be absorbed onto the surface of the workpiece in a manner not entirely dissimilar to the glow discharge of the ion process described above.

In accordance with another aspect of the invention, the hydrogenation reaction substantially occurs in a mixing chamber which is in fluid communication with and at the same pressure as the furnace chamber. The hydrogen gas is metered into the mixing chamber at a flow rate of at least three times that of the unsaturated aromatic hydrocarbon and the temperature of the mixing chamber is maintained between about 700° F. to 1200° F., preferably, about 900° F. to about 1100° F. whereby hydrogenation in a gas phase substantially occurs.

In accordance with another aspect of the invention, the mixing chamber comprises a hydrogenation coil with the number of turns in the coil set to provide a sufficient residence time to hydrogenate a substantial portion of the unsaturated aromatic hydrocarbon within the coil.

In accordance with a still further aspect of the invention, the hydrogenation coil is placed within a heated enclosure which has a varying temperature gradient between its ends with one end thereof at a minimum temperature and the other end at a maximum temperature. The coil is constructed and positioned within the enclosure and connected to the sources of hydrogen and the unsaturated aromatic hydrocarbon such that a) the hydrogen and unsaturated aromatic mix together while traveling in the coil from the coldest end of the enclosure to the hottest end of the enclosure or b) the hydrogen and unsaturated aromatic mix together and travel in the coil from the hottest end of the enclosure to the coldest end of the enclosure before traveling out of the enclosure from the cold end to the hot end or c) the unsaturated aromatic travels in the coil from the hot end of the enclosure to the cold end of the enclosure before mixing with the hydrogen whereupon the hydrogen and the heated aromatic hydrocarbon travel from the cold end of the enclosure to the hot end of the enclosure either through a straight tube or a tube wound as a second coil whereby sudden changes in temperature of the unsaturated hydrocarbon are compensated for in an arrangement which provides sufficient residence time to allow the unsaturated aromatic hydrocarbon to hydrogenate without promoting cracking of the ring and formation of lower or intermediate hydrocarbons other than the desired naphthenes.

Another aspect of the invention related to the preceding object resides in simply measuring the temperature of the coil, such as by temperature probes in coil turns adjacent the coil inlet and outlet, and adjusting the fuel injector position, which dictates the axial position of the coil in the enclosure. By moving the coil in the enclosure towards the "hot" or "cool" end of the enclosure, fine tuning of the temperature of the hydrogenation coil is assured.

In accordance with another aspect of the invention, the rate that hydrogen is metered with the unsaturated aromatic is set to provide a sufficient quantity of hydrogen with the naphthene introduced into the furnace chamber which will be insufficient to allow the carbon potential in the furnace chamber to drop below the carbon saturation limit of the workpiece. However, there is a sufficient quantity of hydrogen to react with carbon produced from the cracked naphthene ring which is not absorbed into the workpiece to form methane while tending to avoid the formation of intermediate or lower form hydrocarbons such as ethylene, acetylene as well as the higher order alkane such as propane. In summary, the hydrogen functions as a "getter" to form methane (the simplest form of hydrocarbon) and is metered at a rate which does not interfere with the saturation of the workpiece surface while avoiding the formation of hydrocarbons which could contribute to furnace sooting.

In accordance with another separate but important aspect of the invention, the rate at which hydrogen and the unsaturated aromatic prior to hydrogenation is admitted to the furnace chamber is variably controlled during the carburizing process so that an excess amount of hydrogen is present in the furnace chamber to prevent the carbon from the cracked naphthene ring achieving saturation levels of carbon in the workpiece. In accordance with this aspect of the invention, the metering of the unsaturated aromatic and hydrogen gas is controlled throughout the carburizing process at set but variable carbon potentials up to saturation. Accordingly, the diffusion step is not required and carburizing process time should therefore reduce. In accordance with this aspect of the invention, variable carburizing in a vacuum furnace is possible. Preferably, the hydrogen is metered with the unsaturated aromatic gas to produce hydrogenation of the unsaturated aromatic. However, some portion of the hydrogen gas can be metered separately into the furnace if the hydrogen in the hydrogenation coil conceivably reaches an excess amount that somehow interferes with the desired hydrogenation of the unsaturated aromatic hydrocarbon.

In accordance with another aspect of the invention, the unsaturated aromatic is provided in liquid form and metered in liquid form into the mixing chamber whereupon the unsaturated hydrocarbon is vaporized into gas from the heat and pressure of the furnace chamber. Unsaturated aromatic liquid feedstock is commercially available with high purity levels thereby assuring repeatability in carburizing results.

In accordance with another important aspect of the invention, a conventional, automotive-type fuel injector is utilized as the mechanism to meter the liquid unsaturated aromatic hydrocarbon into the hydrogenation coil whereby the pulsing of the injector inherently produces an intermittent naphthene gas flow which is conducive to dispersing itself about the workpiece. The liquid fuel arrangement thus produces, by pulsing, a uniform distribution of carbon about the surface of the work which is difficult to achieve when the carburizing gas is conventionally metered in gas form into the gas chamber. Importantly, the pulsing achieved by the fuel injector assists in mixing the hydrogen and unsaturated aromatics in the hydrogenation coil and helps assure that the unsaturated aromatic gas is hydrogenated. Preferably, the pulse width of the injector and the timing between pulses, is varied during the time the hydrogenated aromatic (now naphthene) gas is admitted into the furnace chamber such that the gas can be more readily dispersed about convoluted surfaces of the workpiece and in the space between the workpieces when placed into the conventional workbasket tray. Still more preferably, a plurality of injectors are circumferentially spaced about the furnace chamber and not only is the pulse width and frequency varied during the time the gas is submitted into the furnace chamber, but the firing order or sequence may be varied to positively produce a desired dispersion of gas flow among, against and between the workpieces.

In accordance with a more specific feature of the invention, the injector is provided with an expansion chamber downstream of its outlet and upstream of the hydrogenation coil whereby vacuum from the furnace chamber can be utilized to cause vaporization of the liquid hydrocarbon without adversely causing fluctuating vacuum levels within the furnace chamber proper. While the furnace chamber is under a high vacuum (low pressure) it has been surprisingly discovered that the large volume of the furnace chamber serves to function as a reservoir and dampens the pulsation so that the vacuum functioning of the furnace is not adversely affected by pulsing. However, vaporization of a liquid into gas produces a drop in temperature of the gas which is addressed by the provisions noted above for heating the hydrogenation coil. Accordingly, control of the hydrogenated coil is best achieved by causing vaporization of the gas to occur in an expansion chamber upstream of the hydrogenation coil which in turn is upstream of the furnace chamber proper.

In accordance with another specific but important aspect of the invention, the naphthene hydrocarbon gas is directed against deflection shields which, in turn, direct the carburizing gas against the surfaces of the work. Importantly, the deflecting shields are transparent to the naphthene gas in that the deflecting shields do not contain iron which can function as a catalyst to assist in the cracking of the naphthene ring. Preferably, the deflection shields (which may take the form of radiation shields conventionally used in vacuum carburizing furnaces) have a surface or coating which can comprise a molybdenum or nickel molybdenum alloy having iron content less than about 5%, a graphite or a silica insulation or a ceramic insulation which has developed a graphite like surface.

In accordance with another aspect of the invention, a vacuum furnace for carburizing ferrous workpieces is provided. The vacuum furnace includes a furnace casing defining a furnace chamber proper therein. A heater is provided within the furnace chamber and a vacuum pump with valving is in fluid communication with the furnace chamber. A fuel injection of the pulse operating type is vacuum sealed to an opening in the casing and the fuel injector has an inlet in fluid communication with a source of liquid hydrocarbon under pressure and an outlet in fluid communication with an inlet of a hydrogenation coil which, in turn, has an outlet in fluid communication with the furnace chamber proper for admitting the carburizing gas to the furnace chamber proper. The hydrogenation coil is also in fluid communication with a valved source of hydrogen preferably passing a metered continuous flow of hydrogen through the coil. A microprocessor controller is provided for controlling i) the heater for regulating the temperature of the workpiece in the furnace chamber, ii) the vacuum pump for regulating the pressure of the furnace chamber, iii) the injector for regulating the pulsing of the fuel injector, and iv) the valving for metering of the hydrogen to the hydrogenation coil whereby the carburizing gas flows about, against and between the work surfaces of each workpiece. Preferably the liquid hydrocarbon is an unsaturated aromatic.

In accordance with another aspect of the invention, a plurality of fuel injectors are circumferentially spaced about the furnace casing with each injector having a hydrogenation coil associated therewith and a lance secured to the hydrogenation coil exit and extending into the furnace chamber proper. The furnace casing has an opening with a sealed duct extending therefrom so that the sealed duct is in fluid communication with the furnace chamber proper and forms part of the furnace chamber. In a hot wall furnace having a single furnace casing, the duct has insulation applied over its exterior to establish a temperature differential extending in the direction of coil length whereby the temperature of the hydrogenation coil can gradually increase for better control of the hydrogenation of the unsaturated aromatic. Alternatively, the furnace lining itself can provide a passage serving as the hydrogenation coil duct providing a desired temperature differential.

In general summary of some of the features of the present invention, an improved gas carburizing system (method and apparatus) results from the use of a hydrogenated aromatic (naphthene) as the carburizing medium and the naphthenes are formed by hydrogenating an unsaturated aromatic hydrocarbon. The naphthenes has one or more of the following characteristics:

a) better carburizing case for workpieces having convoluted surfaces and/or tightly packed into work trays (attributed to thermal cracking of a stable HC (hydrocarbon) ring over the catalyst (iron workpiece);

b) minimum soot with bright carburized work (attributed to the stability of the HC ring);

c) minimum sooting with especially bright carburized work and an almost pristine furnace chamber (attributed to external hydrogen and generated hydrogen by-product in combination with the naphthene hydrocarbon);

d) variable carburizing is possible (attributed to ability on cracking of ring to directly form methane with the carbon atoms not absorbed into work);

e) repeatability and consistency of carburizing that can be tightly controlled (attributed to purity of the HC in liquid form);

f) inexpensive processing (cost analysis indicates the high concentration of carbons in unsaturated aromatics result in less use required which is inexpensive);

g) potentially higher throughput (attributed to "localized" reaction of naphthene at the workpiece to flood the surface with carbon atoms and allow, for variable carburizing that eliminates diffusion cycle); and/or, h) easy controllability (attributed to ring allowing for conventional carburizing by a calculated fixed quantity of naphthene to be pumped whereat carburizing stops followed by diffusion or for variable control by methane).

An additional object of the invention resides in a simple gas hydrogenation arrangement where heat from the furnace process is utilized in a controlled manner to achieve gas phase hydrogenation of the unsaturated hydrocarbon gas.

Still another aspect of the invention simply relates to an improved hydrogenation arrangement in which a liquid is pulsed by an injector and vaporized (by the vacuum from the furnace chamber) and the pulsed vapor, (momentum from the injector pulse) enhances the hydrogenation of the hydrocarbon, any hydrocarbon.

These and other objects, features and advantages of the invention will become apparent to those skilled in the art from a reading of the Detailed Description set forth below together with the drawings as described below.

BRIEF DESCRIPTION OF THE DRAWINGS

The invention may take physical form in certain parts and in an arrangement of parts, a preferred embodiment of which will be described in detail and illustrated in the accompanying drawings which form a part hereof and wherein:

FIG. 8 is a cross-sectional view of a cold walled vacuum carburizing furnace modified to accommodate the liquid fuel injectors of the present invention;

DETAILED DESCRIPTION OF THE INVENTION

Figure 1:
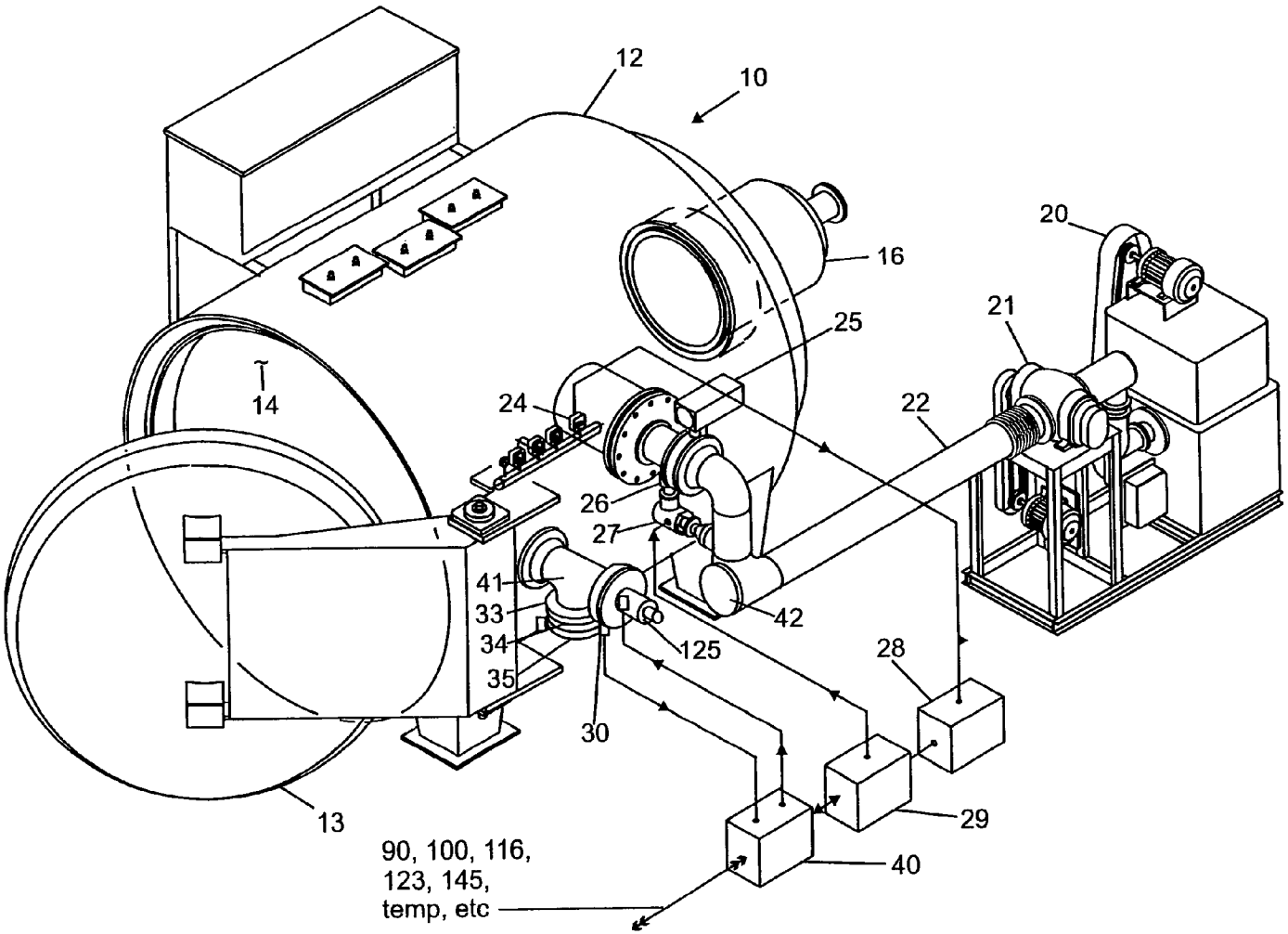
FIG. 1 is a perspective view of a single chamber vacuum furnace with the vacuum connection illustrated.

The Detailed Description of the Invention set forth below is for the purpose of illustrating preferred and alternative embodiments of the invention and is not necessarily for the purpose of limiting the invention.

A. The Hydrogenation and Carburizing Mediums.

Without wishing to be bound by any specific theory, and more particularly, without limiting the invention to any specific chemical theory, it is well known in the petrochemical field to hydrogenate aromatic hydrocarbons, particularly benzene is hydrogenated to cyclohexane. (See for example, U.S. Pat. No. 5,856,602 to Gildert et al., issued Jan. 5, 1999, entitled "Selective Hydrogenation of Aromatics Contained in Hydrocarbon Streams" and its related U.S. Pat. No. 5,773,670, entitled "Hydrogenation of Unsaturated Cyclic Compounds.") Typically, a distillation process is used in the petroleum refinery field. However, gas phase hydrogenation is disclosed in U.S. Pat. No. 4,731,496 to Hu et al., issued Mar. 15, 1988, entitled "Process for the Hydrogenation of Benzene to Cyclohexane" which discloses a nickel catalyst supported on a mixture of titanium dioxide and zirconium dioxide for gas phase hydrogenation. Gas phase hydrogenation was noted to occur at temperatures of 400° C. to 600° C. and at pressures of 30 bar. See also U.S. Pat. No. 6,153,805 to Jose, entitled "Process for Obtaining Cyclohexane by Catalytic Benzene Hydrogeneration" disclosing Group VIII metal catalyzers for gas phase hydrogenation. See also U.S. Pat. No. 3,070,640 to Pfeiffer et al., issued Dec. 15, 1962, entitled "Preparation of Cyclohexane" which mentions the use of iron as a hydrogenation catalyst in a gas phase arrangement where temperatures are controlled at about 650° F. at pressures in the neighborhood of 300 psig. Maximum bed temperature was cited as 440° C. with pressure of 30 kg/cm. In the prior art there is a concern that when producing cyclohexane from hydrogenation of benzene, methylcyclopentane will also be produced by a competing reaction. There is also concern that cracking of the ring can occur with undesirable side reactions. The reaction is exothermic and temperatures have to be closely controlled.

This invention uses gas phase hydrogenation to convert unsaturated aromatic hydrocarbons to saturated hydrocarbons, more preferably to naphthene hydrocarbons, still more preferably to naphthenes having 5 or 6 side carbon rings. Preferred naphthene hydrocarbons include cyclohexane, including variations thereof such as methylcyclohexane, ethyl cyclohexane, dimethyl cyclohexane, trimethyl cyclohexane, etc. and cyclopentane including variations thereof such as methylcyclopentane, ethyl cyclohexane, etc. Unsaturated aromatics that have been tested include benzene, toluene and xylenes and are preferred. It is known that benzene can be hydrogenated to cyclohexane, toluene to methylcyclohexane, xylenes to dimethylcyclohexanes, ethylbenzene to ethylcyclohexane, isopropylbenzene to isopropylcyclohexane, naphthalene to tetrahydronaphthalene and/or decahydronaphthalene. It is believed that all such hydrogenation reactions can be performed in the vacuum carburizing system of the present invention. As a matter of definition, "hydrogenation" as used herein means the chemical addition of hydrogen to a material typically in the presence of a catalyst. "Naphthene" as used herein includes those hydrocarbons (cycloalkanes) with the general formula $C_nH_{2n}$ in which the carbon atoms are arranged to form a ring. Also, as used herein, "cracking" means the breaking or rupture of the carbon ring for naphthenes. Cracking for unsaturated aliphatics means the splitting or disassociation of the hydrocarbon molecule into simpler hydrocarbon forms. As is believed well known, aliphatic hydrocarbons crack according to the radical chain theory proceeding from complex hydrocarbons to intermediates and then to simpler forms with the progress of the reaction depending on the cracking condition.

However, unlike the prior art patents discussed above, this invention hydrogenates the unsaturated vacuum in a vacuum and at high temperatures in the range of 800° F. to 1200° F., more preferably 900° F. to 1100° F. and most preferably at about 1000° F. The hydrogenation occurs in the preferred embodiment in stainless steel tubing having an iron content which is believed to act as a catalyst. Further, it is not pertinent to the invention if competing naphthene reactions occur. For example, it is not material to the invention if the hydrogenation of benzene produces cyclohexane and methylcyclopentane. Further, the hydrogenation (or conceptually the reformation of a hydrocarbon by the addition of hydrogen) produces a naphthene hydrocarbon preferably outside the furnace proper.

The second aspect of this invention uses the naphthene produced by hydrogenation as the carburizing gas in the vacuum furnace chamber proper. Reference can and should be had to our related application filed simultaneously with this application entitled "Vacuum Carburizing with Naphthene Hydrocarbons" incorporated by reference herein and made a part hereof for the reasons why a naphthene hydrocarbon is the carburizing gas of choice.

It is well known that cyclic hydrocarbons, and in particular, 5 and 6 sided naphthenes such as cyclohexane or cyclopentane, are believed more stable than other hydrocarbons and particularly more stable than the aliphatic hydrocarbon family. In particular, the naphthenes cyclohexane and cyclopentane are more resistant to thermal cracking than the unsaturated aliphatics such as propane, ethylene and acetylene. Likewise, the 5 and 6 sided aromatics such as benzene, toluene, xylene and the like provide similar thermal stability. As used herein, "cracking" means the breaking or rupture of the carbon ring for naphthenes. Cracking for unsaturated aliphatics means the splitting or disassociation of the hydrocarbon molecule into simpler hydrocarbon forms. As is believed well known, aliphatic hydrocarbons crack according to the radical chain theory proceeding from complex hydrocarbons to intermediates and then to simpler forms with the progress of the reaction depending on the cracking condition.

Because the purpose of carburizing is to infuse carbon into the case of the workpiece, intuitively, it is believed that one skilled in the art would not select a hydrocarbon that was resistant to thermal cracking. It is also believed that certainly one skilled in the art would not select as the carburizing medium, a hydrocarbon known to produce oily tar deposits in the furnace such as benzene. Accordingly, the recent activity in the carburizing field has for the most part been directed to selecting as the carburizing gas those forms of unsaturated aliphatics, particularly acetylene, with provisions taken to control the carbon sooting that inevitably results from this choice.

However, it is known that the cracking of naphthenes or aromatics, can be quickened in the presence of the catalyst, and catalysts suitable for cracking of naphthenes or aromatics include not only the noble metal elements but also iron.

The working of the invention can conceptually be theorized to occur as follows:

a) The vacuum of the furnace chamber proper which is under low pressure (high vacuum) is used to draw the unsaturated aromatic into the furnace and in the preferred embodiment, to cause vaporization of the liquid unsaturated aromatic to gas. Because of the vacuum, higher temperatures are used with structures that interpose a delay to provide a residence time sufficient to achieve what is believed a substantial hydrogenation of the unsaturated aromatic in the presence of a catalyst, which in the preferred embodiment, takes the form of iron content present in stainless steel tubing. The unsaturated aromatic is chosen to produce a naphthene of desired ring configuration as the carburizing gas. This carburizing gas is drawn into the furnace chamber proper by the furnace vacuum pump.

b) The vacuum furnace also draws the carburizing gas out of the furnace so that the residence time of the gas in the furnace chamber is not long in contrast to, for example, gas atmosphere carburizing. The naphthene or aromatic ring will crack if left at the carburizing temperature over some period of time but the carburizing process tends to negate the cracking by the gas withdrawal at high vacuum.

c) However, the workpiece is iron based and when the gas flows about the workpiece, the residence time is decreased and the ring with its abundance of carbon does crack.

d) By taking steps to assure that the furnace chamber is somewhat transparent in the sense that it does not promote or serves as a catalyst to speed the cracking of the ring, the naphthene gas will then have a tendency to only crack against the workpiece. Activated carbon is thus present in the vicinity of the workpiece where it can be absorbed into the workpiece surface thus minimizing soot.

e) In addition, steps are taken by an injection arrangement to assure that the naphthene or unsaturated aromatic is circulated about the work before being withdrawn from the furnace and is not "dead ended" into the vacuum exhaust port. At the same time, since the naphthene rings possess an abundance of carbon, the process can proceed quickly to saturation.

In summary, a hydrocarbon which has been identified as a culprit causing liquid, oily carbon deposits in the furnace (tar) is selected as the carburizing medium. However this hydrocarbon is reformed, more specifically it is hydrogenated, before it reaches the furnace chamber proper into another hydrocarbon, a naphthenes. However, the hydrogenated hydrocarbon, the naphthenes, while possessing an abundance of carbon, is a saturated carbon ring structure that normally is resistant to breaking down. It is utilized as the carburizing medium because iron can function as a catalyst readily breaking down the stable hydrocarbon at the carburizing temperatures. Then, steps are taken to minimize catalytic reactions with the stable ring hydrocarbons in the furnace chamber except for where the workpieces are so that the carbon produced can be readily absorbed in the workpiece case. Additional steps are taken to insure circulation of the hydrocarbon about the work. Finally, hydrogen added to achieve hydrogenation of the unsaturated aromatic to a desired naphthene is also added at an "excess" quantity to insure minimization of carbon soot, for control of the process and finally to achieve equilibrium or variable carburizing.

The above paragraph is a conclusionary summary of the "workings" of the invention based upon observations, tests, measurements, experiments, etc. and clarifications through technical analysis. The above paragraph is also consistent with what is expected or taught in the gasoline reforming art. In that art it is known that iron is a naphthene catalyst and that cracking of the ring will result in carbonaceous compounds that will be absorbed into and foul the catalysts. One reforming technique teaches isomerization of the feedstock by special catalysts under controlled conditions with ratios of hydrogen to hydrocarbon fed in excess of stoichiometric requirements so that the naphthene ring is opened (not "cracked") and the ring hydrocarbon can be isomerized to the desired branch chain hydrocarbon. (See U.S. Pat. No. 2,348,557 to Mattox, entitled "Treatment of Hydrocarbon Distillates", issued May 9, 1944; U.S. Pat. No. 2,915,571 to Haensel, entitled "Isomerization of Saturated Hydrocarbons", issued Dec. 1, 1959; and, U.S. Pat. No. 4,783,575 to Schmidt et al., entitled "Isomerization with Cyclic Hydrocarbon Conversion", issued Nov. 8, 1988.)

The technical analysis of the carburizing reaction with naphthene as the carburizing medium is set forth in detail in the related patent application filed simultaneously herewith and will not be set forth in detail herein. Reference to that patent application for a detailed analysis. However, a summary of the technical analysis is set forth below.

A) Unsaturated aromatics and naphthenes have a high degree of reactivity and should function well to provide excessive amounts of carbon to the workpiece. They produce carbon sooting and tar. This has not been experienced because the furnace chamber proper is always clean and the workpiece bright. It is concluded first, that the hydrogenation arrangement disclosed herein successfully hydrogenates the substantial portion of unsaturated aromatics metered into the furnace. If the unsaturated aromatics were present in any quantity in the furnace chamber proper, benzene rings would form tar and carbon sooting would occur from lighter fraction hydrocarbons. Second, the naphthenes effectively cracked and excess carbon was formed into methane.

B) Methane is substantially inert to carburizing at the pressures of the process which are from 2 to 100 torr, preferably from 2 to 20 torr and most preferably from about 7.5 to 10 torr.

C) Hydrogen is a "getter" for activated carbon resulting from cracking of the hydrocarbon ring to form methane. So long as the furnace chamber is not starved for hydrogen, methane will tend to form as a by-product of the reaction and not intermediate hydrocarbons that produce carbon sooting. More specifically, the by-product gases produced are substantially methane and hydrogen, "substantially" meaning that the gases at the end of the reaction or the by-product gases include methane and hydrogen which together comprise at least 50% of the by-product gases.

D) By in-situ analysis of the methane composition in the furnace chamber, the carburizing process can be controlled. That is the hydrogen to hydrocarbon ratio can be controlled by the methane composition so that carbon potential is controlled to assure saturation of the carbon into the iron at the workpiece surface. Preferably, in-situ methane detection can be accomplished by an infrared sensor although residual gas analyzer, mass spectrometer or paramagnetic detectors can be used.

E) Methane analysis alone through mathematical/empirical relationships or in-situ detection of methane and hydrogen can control the process so that the carbon potential of the carburizing gas can be controlled to be less than saturation. Accordingly, variable or equilibrium carburizing is possible.

B. The Vacuum System.

Referring now to the drawings wherein the showings are for the purpose of illustrating an embodiment of the invention and not for purposes of limiting the invention, there is shown in FIG. 1 a single chamber vacuum furnace 10 which basically comprises a vacuum tight furnace casing 12 (actually a cylindrical casing or "liner" with one end sealed by a spherical casing) having an open end which is vacuum sealed by a door 13 to define a vacuum tight furnace chamber "proper" 14 or pressure vessel therein. In a "hot wall" vacuum furnace a single casing is used on which furnace insulation is mounded. A temperature gradient exists across the insulation from the furnace temperature inside furnace chamber 14 to the outside of the furnace which is typically at temperatures of 120° F. to 140° F. In a "cold wall" vacuum furnace, two vacuum tight furnace casings, one inside the other, are generally used to form a water jacket therebetween. Coolant in the water jacket keeps the outside casing cool. The furnace illustrated is a cold wall type and has furnace insulation secured to the inner chamber assembly of the casing.

Mounted to the spherical end of furnace casing 12, is a fan 16 used for gas quenching of the carburized parts. In one version of a hot wall furnace, when the fan is used for cooling, an exhaust cooling duct extends from one side of the furnace chamber to the diametrical opposite side and is provided with means for cooling the exhaust gas. This is not shown in FIG. 1 for drawing clarity reasons. The exhaust duct remains open and is thus under a vacuum when the furnace is carburizing. Thus, furnace chamber 14 which is shown as including the space defined by furnace casing 12 (i.e., the furnace chamber "proper") also includes by definition an atmosphere cooling duct of the type mentioned if the furnace includes such a cooling duct because the atmosphere exhaust cooling duct is welded vacuum tight to furnace casing 12. Also a portion of the atmosphere exhaust cooling duct "sees" the temperature of the furnace chamber proper during carburizing and has a temperature differential extending over at least a portion of its length. In one prototype, the exhaust duct was an ideal location to place the hydrogenation coil of the present invention to determine the effects of temperature on the hydrogenation coil.

The furnace design illustrated in FIG. 1 was chosen for its simplicity. As is well known, the furnace can be provided with a separate liquid quench chamber, a vestibule for loading and unloading the work, special doors between chambers, etc. and the designation "vacuum furnace" as used herein is intended to cover all known variations of a vacuum carburizing furnace including the plasma or ion-glow furnaces.

The vacuum system for furnace 10 includes a pump 20 and a pump blower 21 connected to a vacuum exhaust duct 22 leading into furnace chamber 14. Within furnace chamber 14 is a pressure switch or vacuum gauge 24. Outside furnace chamber 14 is an evacuation valve 25 (i.e., EVAC valve), a tight shut-off valve 26 and a choker valve 27. The control includes a pressure transducer electronic readout 28 and a PID microprocessor loop controller 29. As shown, pressure transducer 24 is wired to optional pressure transducer readout 28 and the choker valve is controlled by PID controller 29. The choker valve is actually in a by-pass vacuum leg. When the carburizing gas is metered the EVAC valve 25 is closed and choker valve 27 regulates the vacuum in the furnace chamber 14 so that gas is drawn out at the same rate it is admitted into the furnace. This is entirely conventional.

Figure 10:
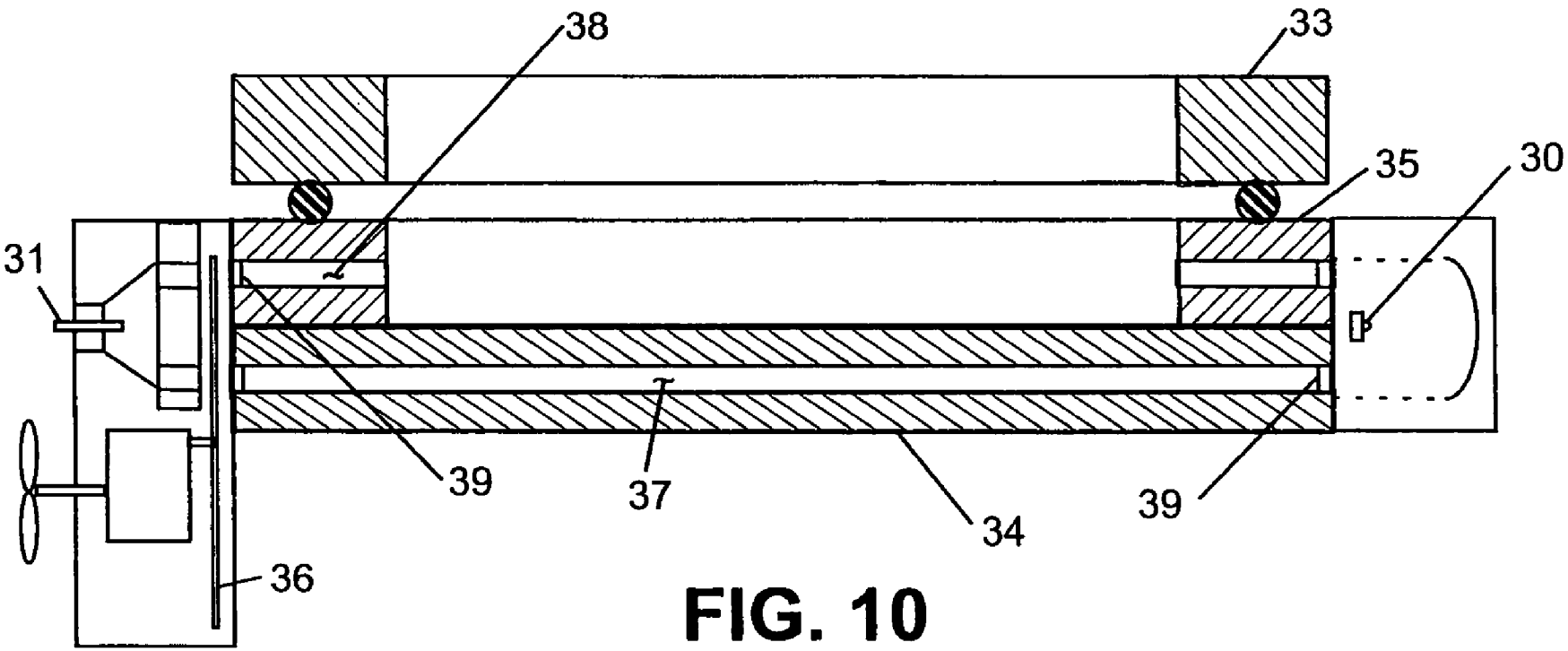
FIG. 10 is a schematic cross-sectional view of the prototype in-situ infrared sensor used to measure methane in the furnace.

Also shown in FIGS. 1 and 10 is an infrared detector 30 and the infrared source 31 for detector 30 which is shown connected to a master controller 40. In the prototype embodiment, an auxiliary vacuum duct 41 exists which is provided with an annular flange 33. A closed circular plate 34 was welded vacuum tight to an annular sensor flange 35 which, in turn, was bolted, vacuum tight, to annular flange 33. In closed circular plate 34 there is drilled a through passage 37 which functions as the reference chamber for the infrared sensor. A similar overlying passage 38 is drilled in annular flange 35 and both passages are provided with sapphire windows 39 at their ends (4 total) which are diametrically opposed. Sapphire windows 39 are provided with O-ring seals and function as a vacuum barrier for sensor, filters and source while sensitizing the methane wavelength. Mounted external to the windows and circular plate 34 in annular flange 35 is infrared source 31 which includes a fan and chopper 36 and is a dual beam source in the sense that infrared light is directed through the passages in both closed circular plate 34 and annular flange 35. At the opposite sapphire window is mounted detector 30 which has a parabolic mirror. If multiple gases were to be analyzed by the infrared sensor, for example, the presence of intermediate hydrocarbons such as propene, ethylene, etc., additional detectors 30 could be circumferentially spaced about additional sight passages drilled in sensor annular flange 35 and the detector could be equipped with a single rotating chopper disk or multiple rotating disks or, alternatively, annular flange 35 could be equipped with reflecting mirrors to transmit the infrared radiation to the circumferentially spaced detectors. The infrared detector 30 is an analog device as illustrated. The invention can use other types of non-dispersive infrared sensors including those with electronics that do not require a reference passage.

Because furnace chamber 14 is under vacuum, the sensor can be situated anywhere upstream of EVAC valve 25 and choker valve 27 in anything that is in fluid communication with furnace chamber 14 and "in-situ" is used herein in accordance with this meaning. In FIG. 1, there was an additional port in furnace casing 12 for mounting an infrared sensor. Preferably, the sensor is close to furnace chamber 14 but it can be several feet away which will produce a minor delay in response time. It is to be noted because furnace chamber 14 is under a vacuum, adding a "dead-end" duct 41 to the furnace chamber "proper" simply increases the size and configuration of the furnace chamber to include the added passage. Because the vessel is under vacuum, the atmosphere in the added passage is the same as that in the furnace chamber "proper". In conventional furnaces at positive pressures, the composition of the furnace gas in an added duct is most probably not that of the atmosphere in the furnace chamber. The sensor can not be mounted downstream of the EVAC valve or choker valve such as in vacuum exhaust duct 22 because the temperature is dropping, pressure is much lower, and the flow is not steady. While furnace chamber 14 is observed as clean, the exhaust duct 22 has been observed to contain carbon deposits. The temperature drop downstream of the evacuation valves is believed to cause the carbon in combination with the relatively small size of the exhaust duct. An access cover 42 with a removable liner in the exhaust duct is contemplated in the commercial application.

Also mounted to dead end duct 41 is a fuel injector 125 which will be discussed further below. Fuel injector 125 has a lance 53 which extends into furnace chamber proper 14. Dead end duct 41 provides an enclosure which has a varying temperature differential along its length or one which by applying insulation can have a varying temperature differential of set temperature ranges suitable for mounting the hydrogenation coil. It is disclosed in FIG. 1 as one example of one means of positioning the injector and a hydrogenation coil 50.

Also shown in FIG. 1 is a master controller 40 which communicates to and from PID loop controller 29. Master controller 40 allows the operator to set process variables and reads out operating data in visual or print form, allows the operator to intervene, sounds alarm warnings, and in a more sophisticated version, can adaptively tune itself, collect and perform trend analysis, provide SPC functions, etc. For the vacuum system disclosed in FIG. 1, master controller 40 will provide PID controller 29 with the desired vacuum levels which PID controller 29 will implement. Also, master controller 40 will control pulsing of fuel injector 125 as shown. Additionally, master controller 40 will control the mass flow controller for the hydrogen gas metered to the furnace. Additionally, master controller 40 will send command signals to, and receive monitoring signals from, the temperature controllers which the furnace is equipped with, insure the interlocks are properly activated, control the valving for metering of the gases, control the firing of the injectors, etc. In the preferred embodiment, assignee's DataVac.RTM. controller performs these functions.

The pressure control loop shown in FIG. 1 is quite simple. Choker valve 27 is placed between vacuum pump 20 and furnace chamber 14. Its purpose as noted is to restrict the pump and let the pressure rise. That is, if hydrocarbon gas is flowing and evacuation valve 25 is closed, the pressure in furnace chamber 14 will eventually reach atmospheric pressure. Choker valve 27 simply positions itself to allow vacuum pump 20 to take away the gas from furnace chamber 14 at the same flow rate as that at which gas is introduced into furnace chamber 14.

The process cycle, whether the hydrocarbon medium is metered as a gas or liquid, is a follows:

1) Load furnace and close door 13.

2) Make sure pressure control loop 29 is set for maximum to fully open evacuation valve 25 to speed pump down rate.

3) Start DataVac.RTM. controller 40 recipe.

4) Pump down to 35 microns. Any value from 10 to 200 microns is acceptable and common. Heat the work to 1700° F., or any desired carburizing temperature.

5) Soak load at temperature to assure uniform carburizing.

6) If gas injection is used (see FIG. 5), start up vaporizer. Vaporizer pressure set point is 20 psig and temperature is 200° F.

7) If gas injection is used (see FIG. 5), make sure vaporizer is stabilized for pressure and temperature.

8) Set PID controller 29 to 9.500 torr or any other desired pressure set point.

9) Pressure control system closes choker valve 27, attempting to raise furnace pressure from 35 to 75 micron range to 9.500 torr. The system will not accomplish this until hydrocarbon gas begins to flow.

10) Start carburize portion of cycle by opening shut-off valve for gas injection shown in FIG. 5, or start liquid injection (see FIG. 2 as explained below). DataVac.RTM controller 40 performs this automatically whether gas or liquid hydrocarbon is injected.

11) Set mass flow controller 100 and injector 125 (if liquid is injected) via DataVac controller 40 for desired gas flow.

12) Carburize for a set time to accomplish desired case depth.

13) Turn off carburizing gas flow.

14) Set PID controller 29 to "0" or maximum opening of choker valve 27.

15) Begin diffuse cycle.

16) Once diffuse cycle is complete, DataVac.RTM. controller 40 will lower temperature to pre-quench temperature, typically, 1550° F.

17) Gas quench, oil quench, or slow cool.

18) Cycle complete.

The system is more automatic if a liquid injector system is used since vaporizer temperature and pressure control loops are eliminated.

Pressure transducer 24, in the preferred embodiment, is an MKS transmitter that is a diaphragm type transducer that measures absolute vacuum or furnace pressure levels regardless of gas chemistry in the furnace. Vacuum sensors built around temperature changes within the sensor such as a thermocouple gauge tube or pirani gauge will not work without mathematical compensation, but the MKS transmitter works fine and is used routinely in assignee's ion carburizer and ion nitrider furnaces. A 0 to 10 vdc signal from transducer 24 goes to optional readout device 28 and on to PID controller 29 which, in one embodiment of the invention, is a Honeywell UDC 3000 controller or equal. This loop could easily be done in the DataVac.RTM. controller 40 or a PLC controller. The UDC-3000 opens choker valve 27 to move down in pressure toward 35 microns and closes choker valve 27 to move up in pressure toward atmospheric pressure. If there is too much flow into the vessel, the controller will open the choker and allow the pump to pull the vacuum back down. Likewise, if the flow becomes too low into the furnace, choker valve 27 closes and pressure moves back up.

C. The Hydrogenation Coil.

As noted, this invention hydrogenates or reforms the unsaturated aromatic to substantially naphthene hydrocarbons. In its broader sense, this invention uses any known method to hydrogenate the unsaturated aromatic including the prior art liquid hydrogenation systems. However, it is preferred that hydrogenation occur in the gas phase because the naphthene hydrocarbon must be vaporized when in the furnace chamber proper.

Accordingly, this invention mixes hydrogen and unsaturated aromatics, as gases, in a mixing chamber which is in fluid communication with the furnace chamber proper. Thus, the mixing chamber is at the same vacuum as the furnace chamber proper (and technically, is part of the furnace chamber). The moles of gas that can occupy the mixing chamber is therefore reduced when compared to the moles of gas that could occupy the mixing chamber if at positive pressure and the high vacuum (low pressure) draws the gas out of the mixing chamber rapidly. To provide residence time for the hydrogenation reaction to occur, the mixing chamber is constructed to provide a tortuous flow path that delays the time the gases are in the mixing chamber (to increase residence time) while providing gas contact of hydrogen with the unsaturated aromatic hydrocarbon to promote mixing of the gases during the residence time. Any structure that accomplishes this objective is satisfactory. For example, a honeycomb matrix having zig zag passages in the matrix or gas permeable matrix walls with blockage of alternating wall ends could conceivably function as a mixing chamber. However, in the preferred embodiment, a tube formed as a hydrogenation coil has proven acceptable.

Heat must also be provided for the hydrogenation. In the preferred embodiment, the hydrogenation coil is placed in a heated enclosure. The heat from the enclosure heats the coil and the coil in turn heats the gases passing inside the coil. The turns in the coil in combination with the vacuum drawn in the coil assure gas mixing as the gases pass through the coil turns. In addition, when the fuel injector embodiment is utilized and the aromatic is pulsed into a moving hydrogen stream, the pulsing, per se, produces mixing. Unlike the patent literature, it has been determined that (at the low pressures of the invention) if the coil is maintained at temperature between about 700° F. to 1200° F., more preferably between temperatures of 900° F. to 1100° F. and still more preferably at a temperature of about 1000° F., the furnace chamber proper is substantially free of carbon soot and tar and extremely favorable carburizing conditions occur. In fact, the same type of carburizing occurs as when a gaseous naphthene is introduced directly into the furnace chamber as is done in the related application. The conclusion is therefore drawn then that the unsaturated aromatic has been hydrogenated in the hydrogenated coil to a naphthene. This is further buttressed by the fact that similar methane sensor readings are detected during the carburizing cycle when carburizing occurs with benzene hydrogenated to cyclohexane compared to carburizing with pure cyclohexane. Also, while it is known that carburizing can occur with benzene as the carburizing gas, an oily film is deposited in the furnace chamber if benzene is directly injected into the furnace proper (even with the improved liquid injection arrangement disclosed herein). The film is not present with the hydrogenation coil.

It should also be noted that the gas leaving the hydrogenation coil lance and entering the furnace chamber has not been analyzed. Even though an abundance of hydrogen is mixed with the unsaturated aromatic (A minimum hydrogen flow rate three times that of the unsaturated aromatic is needed for hydrogenation. This flow rate is increased to supply excess hydrogen to prevent final formation of objectionable hydrocarbons in the furnace proper.), it is possible that some minor portion of the unsaturated aromatic has not hydrogenated or some minor portion of the hydrogenated unsaturated aromatic has cracked. All that can be the is that a "substantial" portion of the unsaturated aromatic has been hydrogenated in the process, meaning that whatever portion has not been hydrogenated, the non-hydrogenated portion does not constitute a percentage that would produce oily films in the furnace chamber.

Assume that some minor portion of the unsaturated aromatic does not hydrogenate to a naphthene by the time it enters the furnace chamber proper. The unsaturated aromatic is believed to crack in a manner similar to that of the naphthene. The problem is believed to center about either un-reacted unsaturated aromatics or re-formation of the unsaturated aromatics into benzene rings linking together to form tar or tar-like residuals. The excess hydrogen in the furnace chamber proper is believed to resist the formation of or linkage of the benzene rings. It is believed that so long as the unsaturated aromatic does not comprise a majority (meaning 50% or more) of the carburizing gas in the furnace chamber proper and there is sufficient hydrogen, the oily deposits will not form and repeatability of the process is assured. That is, it is known that oily deposits from ethylene (an unsaturated aliphatic which has a different behavior than ring hydrocarbons) can be controlled with high quantities of hydrogen in vacuum carburizing preventing benzene ring linkage. Control of the process is a concern. By keeping the quantity of unsaturated aromatics to a minimum (i.e., those unsaturated aromatics that fail to hydrogenate) and then having sufficient hydrogen present to prevent linkage of benzene rings from any of the minimum unsaturated aromatics which do not crack or otherwise may or could tend to form rings, the process remains under repeatable control (producing consistent results cycle after cycle). The point is that the invention recognizes that not all of the unsaturated aromatic's feed supply may be reformed to, or hydrogenate into, the preferred naphthene, and that it is potentially possible that more than "trace" amounts of unsaturated aromatic will be present. Conceptually, so long as the majority of the carburizing gas is a naphthene, the minor unsaturated aromatic gas portion should not present a process problem and the excess hydrogen present in the furnace (resulting from the high supply of hydrogen to the hydrogenation coil and the generation of hydrogen from the carburizing hydrocarbons during the carburizing process) should be sufficient to prevent formation of oily residuals.

As noted, from a mathematical consideration, the flow rate of hydrogen to the unsaturated aromatic should be 3 moles of hydrogen to every 1 mole of unsaturated aromatic. However, assume a tolerance for some portion of the unsaturated aromatic to be metered into the furnace proper and the hydrogen resulting from the hydrocarbon carburizing gas being also available to form methane from the rings. If this is also considered, the flow rate can be reduced. In fact, the example cited below used a flow rate of approximately 1½ l/m of hydrogen to 1 l/m of unsaturated aromatic. Further, to evaluate the tolerance of the process to processing unsaturated aromatics with naphthenes, blends of unsaturated aromatics and naphthenes were injected into the furnace. In fact, carburizing was achieved with a mixture of 50% naphthene, 25% benzene and 25% toluene with approximately a 3 to 1 molar flow rate of hydrogen to the mixture. This indicates that the hydrogenation coil could hydrogenate only 50% of the unsaturated aromatics and the process could still successfully carburize the work. Thus, to establish some limits for the invention, the flow rate of hydrogen to the flow rate of the unsaturated aromatic should be determined considering the amount of hydrogen needed to hydrogenate the specific unsaturated aromatic being used and then determine the amount of hydrogen from the hydrocarbon carburizing gas and any excess hydrogen needed (pursuant to the discussion below) to achieve the desired carbon potential while preventing formation of hydrocarbon intermediates. A flow rate of 3 molar parts hydrogen to 1 molar part of aromatic will achieve this. However, the flow rate of hydrogen can decrease to as low as 11/4 to 11/2 hydrogen to 1 part aromatic. As far as the "efficiency" of the hydrogenation coil is concerned, a coil that causes about 50% or more hydrogenation should still produce an acceptable carburizing process.

In the preferred embodiment of the invention, it is preferred that the mixing chamber (i.e., the hydrogenated coil) gradually raise the temperature of the hydrogen and unsaturated aromatic gases to the final hydrogenation temperature noted above. When the unsaturated aromatic is supplied in liquid form and injected into the hydrogenation coil by a fuel injector (described below) the vacuum induced, vapor phase change causes a drop in temperature. Although hydrogenation is an exothermic reaction, the temperature drop has to be compensated for and it is preferred to compensate for this by controlling the temperature of the hydrogenation coil by the heat from the enclosure that the hydrogenated coil is placed in.

Figure 2:
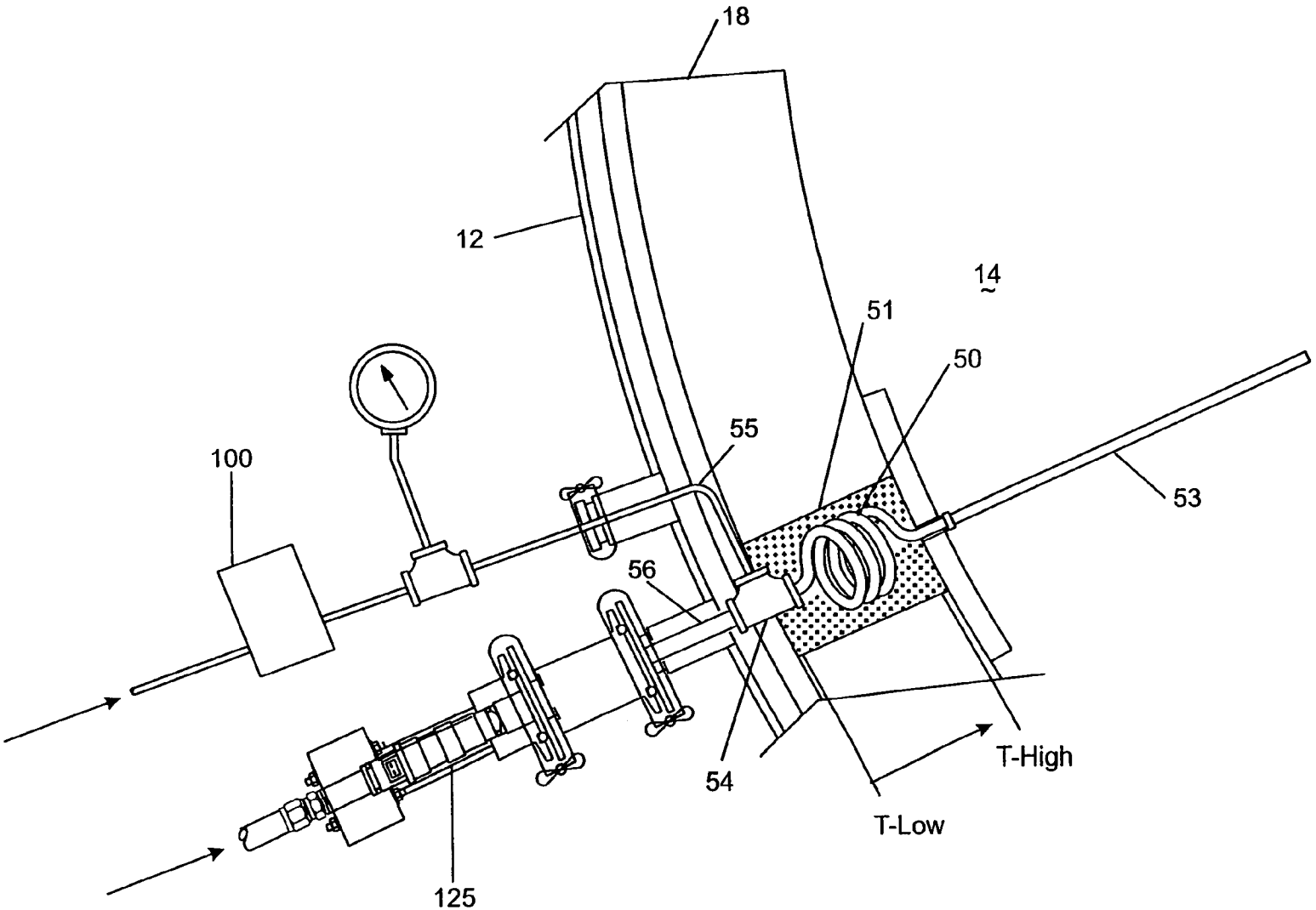
FIG. 2 is a perspective view of the hydrogenation coil arrangement used in the invention.
Figure 3:
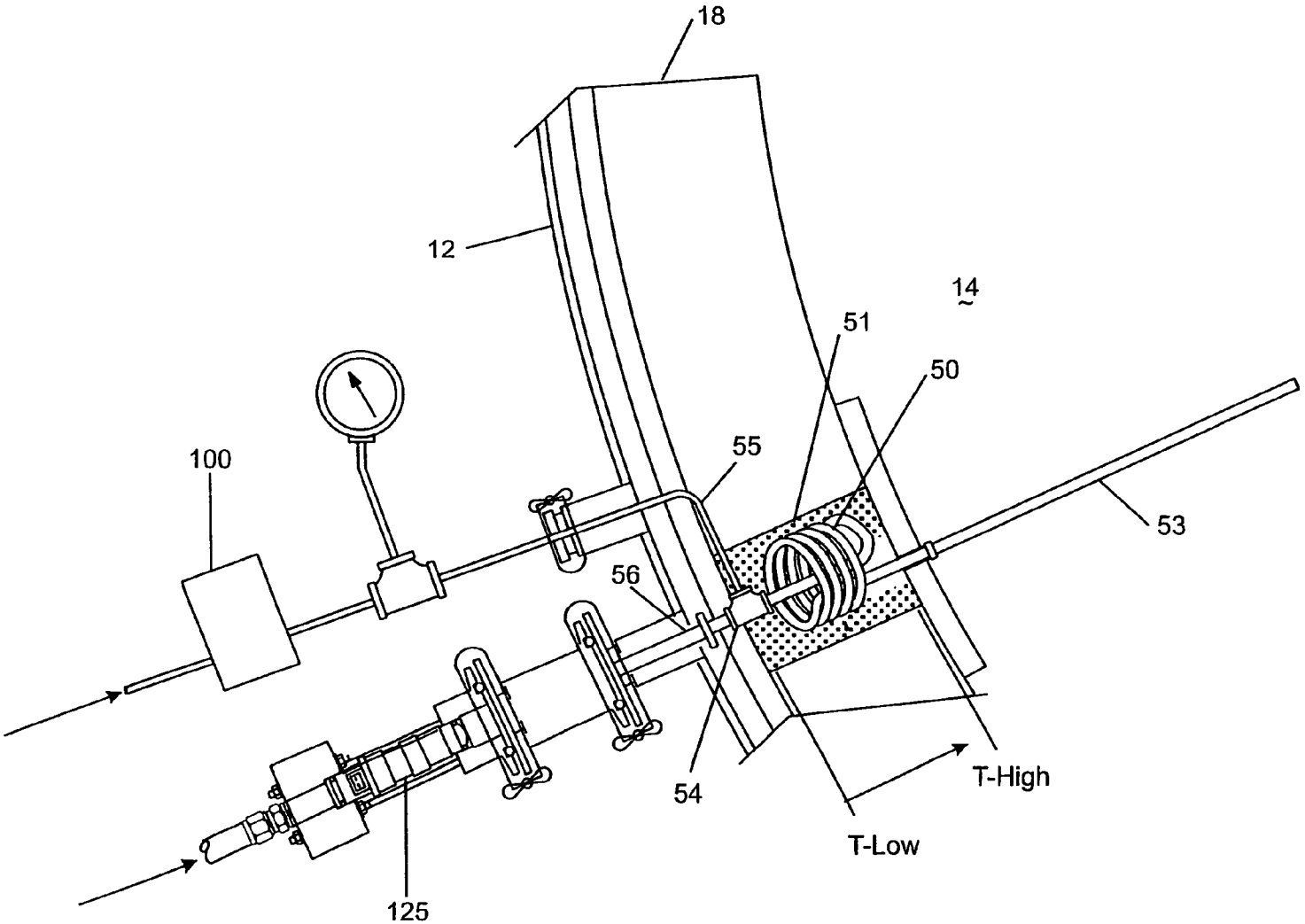
FIG. 3 is a perspective view similar to FIG. 2 but showing a different form of the hydrogenation coil arrangement used in the invention.
Figure 4:
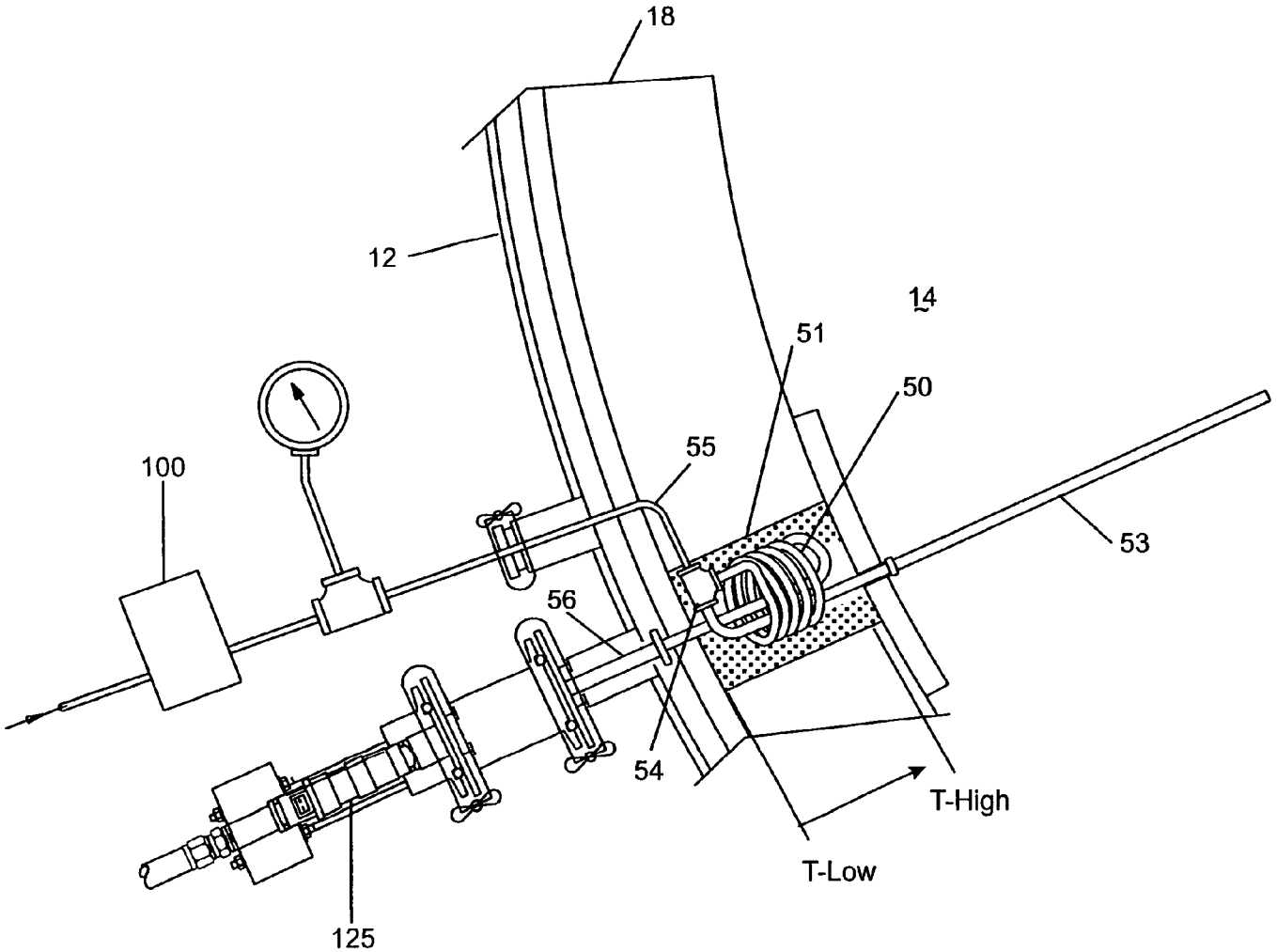
FIG. 4 is a perspective view similar to FIGS. 2 and 3 but showing a different form of the hydrogenation coil arrangement used in the invention.

Referring now to FIGS. 2, 3 and 4, there is illustrated several variations for plumbing a hydrogenation coil 50. In all three figures, a hot wall vacuum furnace is illustrated. This hot wall furnace has a single casing 12. Ceramic block or board insulation 18, approximately 12" in thickness, is applied to casing 12. A passage or coil enclosure 51 is formed in insulation 18 for hydrogenated coil 50. Because the furnace chamber 14 is at the carburizing temperature (assume 1750° F.) and the casing 12 is at a temperature of 110° F. to 120° F., the coil enclosure 51 is at a high temperature designated $T_H$ of 1750° F. at its exit and a low temperature $T_L$ at its entrance of 110° F. to 130° F. with a temperature gradient along the 12" length of insulation. In practice, thermocouples adjacent the $T_H$ Coil turn and the $T_L$ Coil turn determine the position of hydrogenation coil 50 in coil enclosure 51. It is relatively simple to variably thread injector 125 into and out of the enclosure to assure precise positioning of the hydrogenation coil 50 relative to insulation 18.

In all of the illustrations, the coil outlet is connected to a lance 53 which has an outlet ending in a set position in furnace chamber 14. At the opposite coil end is a T connection 54 which receives hydrogen gas from a hydrogen feed line 55. Unsaturated aromatic gas is supplied from an aromatic feed line 56 extending from the fuel injector.

In the FIG. 2 embodiment, aromatic gas line 56 is plumbed into T connection 54 so hydrogen gas and unsaturated aromatic gas are mixed together in T connection 54. The two gases then enter coil 50 from $T_L$ and travel to $T_H$ where they are released into lance 53. This is a straight forward application of hydrogenated coil gradually heating the gas mixture to a maximum temperature at the $T_H$ side of enclosure 51.

In the FIG. 3 embodiment, hydrogen line 55 and aromatic line 56 are plumbed into T connection 54 where the two gases come into contact with one another. The two gases then travel to the $T_H$ side of hydrogenation coil 50 where the coil is entered. The gases travel backward to the $T_L$ side of the coil and then travel in a straight coil extension to lance 53. This arrangement is designed to try and bring the gases to the hydrogenation temperature quickly. The $T_L$ side of the coil is actually at the preferred temperature range.

In the FIG. 4 embodiment, the unsaturated aromatic travels from aromatic line 56 to the $T_H$ side of coil 50 where it enters the coil, travels backward to the $T_L$ side of the coil and then enters T connection 54. The heated unsaturated aromatic gas then contacts hydrogen from hydrogen supply line 55 in T connection 54 and the two gases then travel in a straight "coil extension" to lance 53. This arrangement is designed to compensate for the temperature drop experienced by the unsaturated aromatic when it changes phase by inputting heat to the unsaturated aromatic. Hydrogenation occurs in the straight leg portion of the coil downstream of T connection 54.

The hydrogenation coil of the invention is not limited to the arrangements shown in FIGS. 2, 3 and 4, which are merely examples of some embodiments. There can be coils within coils, and coils having reverse turns, and turns can have varying diameters. In the preferred embodiment, hydrogenation coil 50 and lance 53 are stainless steel and the iron content therein is believed to act as a hydrogenation catalyst. Other catalytic coatings and/or coil compositions can be used such as any of those mentioned in the prior art hydrogenating petroleum field patents. Also, the diameter of coil 50 and lance 53 in the preferred embodiment was set at ⅜", which proved effective. However, other sizes may be used to obtain different residence lines. Variations in the coil enclosure are also possible. For example, enclosure 51 could be continued through furnace casing 12 and a duct constructed outside of furnace casing 12. This is conceptually illustrated in FIG. 1 and FIG. 6. The duct being open into the furnace would see some radiation and be heated. Varying insulation on the duct would control the temperature along the duct.

Hydrogenation has been described as occurring within coil or in the enclosure 51 where it is believed to occur. However, hydrogenation can occur or continue to occur within lance 53. In one of the tests where hydrogen was somewhat starved, the lance tip glowed during carburizing. This was attributed to the excess hydrogen in the furnace chamber proper ($H_2$ resulting when carbon is absorbed from the ruptured cyclohexane ring). Hydrogenation which is an exothermic reaction was thus happening at the lance exit because of the free hydrogen in the furnace chamber proper and heating the lance tip despite the high furnace proper temperature. This is not desired, but it does indicate that hydrogenation can occur within lance 53. So long as the unsaturated aromatic is substantially hydrogenated before leaving lance 53, this is all that is required.

D. The Hydrocarbon Delivery System.

The unsaturated aromatic is supplied in liquid form. In commercially available liquid form, the purity of the unsaturated aromatics, such as benzene and toluene, is higher than the purity of conventional carburizing mediums in gas form which can have trace amounts of gases with oxygen present therein. Specifically, unsaturated aromatics can be supplied inexpensively at purity levels in excess of 99.5%. Further, the trace "impurities" are hydrocarbons which, in any form and at the low concentrations, will not have any negative impact on the carburizing process. Thus, using the unsaturated aromatics in liquid form will insure reliable, consistent results from one carburizing run to the next. It should also be clear that unsaturated aromatics are commonly blended and the blends have purity levels consistent with the purity levels of the individual blend components.

There are conceptually four ways in which the liquid unsaturated aromatics can be used in the carburizing process and this invention, in its broader sense, contemplates using any of the four metering methods discussed below although one is definitely preferred. The four approaches for using the unsaturated aromatics in liquid form are as follows:

A) Direction injection via a simple control valve into the vessel.

B) Vaporizing the liquid with an external heater. This approach has been used on the assignee's Nanodyne methanol disassociator orders presently running in the field.

C) External vacuum vaporizing.

D) Small time pulse injection charges.

The following outlines the methods for introducing the liquid unsaturated aromatic hydrocarbon into the furnace:

A) Direct injection via a control valve is by far the simplest in regard to hardware. A small needle valve allows a low pressure liquid supply to be admitted into T connection 54 as shown and then to hydrogenation coil 50. The draw back to this simplest method is a rather rapid expansion of the liquid flow due to the low pressure around the liquid, temperature drop due to vaporization, and bursts of gas that will be generated. These bursts may cause the furnace pressure to swing up and down and cause the flow of hydrogen, which is constant, to vary the hydrocarbon to hydrogen ratio. The gas mix level of consistency may be varying over time. This arrangement is not preferred.

B) Vaporizing the liquid with an external heater operating about 160° F. to 220° F. (depending on the hydrocarbon selected), to generate a gas which can be easier to mix with the hydrogen. The heater does require additional hardware and heat wrapping of the pipe leading to the furnace is typically required.

C) External vacuum vaporization does not use a heater, but simply allows the furnace vacuum to travel back to a surge tank where the liquid is allowed to enter the bottom of the expansion tank through an evaporation control needle valve. Depending on the liquid used, the vapor pressures are in the range of 25 to 95 torr. By keeping the pressure in the surge tank to levels that are lower, the small amounts of liquid entering the tank through the bottom-located expansion valve will cause these drops of liquid to immediately vaporize due to the low torr level in the tank. The flow of gas then goes to the furnace under vacuum and no heater or heat wrapping is required. Flow of liquid into the tank would be controlled by a separate valve between the liquid and the evaporation tank. The liquid tank would be blanketed with up to about 4 psig nitrogen or argon to keep the tank contents free of oxygen and to allow make-up of the volume of the tank created by the usage of the gas. This is feasible but not preferred over (C).

D) The fourth method, which is the preferred embodiment of the invention, uses a simple, low cost automobile fuel injector which is suitable for handling hydrocarbons of the inventive type. A supply pressure ranging from 5 to 50 psi from a small positive displacement fuel pump and fuel regulator is used in one embodiment. These components are fairly inexpensive and are readily available and have demonstrated excellent reliability. The fuel injector will time pulse on for a period of time on the order of milliseconds and inject small shots of liquid hydrocarbon directly into an expansion chamber leading to hydrogenation coil 50. A constant hydrogen flow into the coil arrangement will be supplied from a separate flow control valve. The shots of liquid are small enough and under sufficient pressure to allow complete injection without the risk of pressure bubbles and blockages etc., that might occur with method "A" listed above. Increasing the duty cycle of the gas flow pulse to the injector will increase the flow of liquid. Pulses of gas can occur. The duration or pulse would increase from a few milliseconds for low surface area loads to perhaps 500 milliseconds for high surface area loads at a frequency of every second to longer periods, say every 15 seconds or short periods, say ⅓ of a second. Injecting more often will also allow more volume of hydrocarbon to be added to the system.

For consistency in terminology, "metering" means introducing the cyclic hydrocarbon into the furnace in any form and "injection" means introducing the cyclic hydrocarbon in liquid form to the furnace. "Metering" therefore includes "injecting." "Injecting" however, as used herein, precludes or does not cover the use of any valving arrangement which regulates the flow of gas to the furnace. Injecting can be accomplished by a fuel injector or a liquid pump with appropriate valving.

1) The Gas Metering System.

Figure 5:
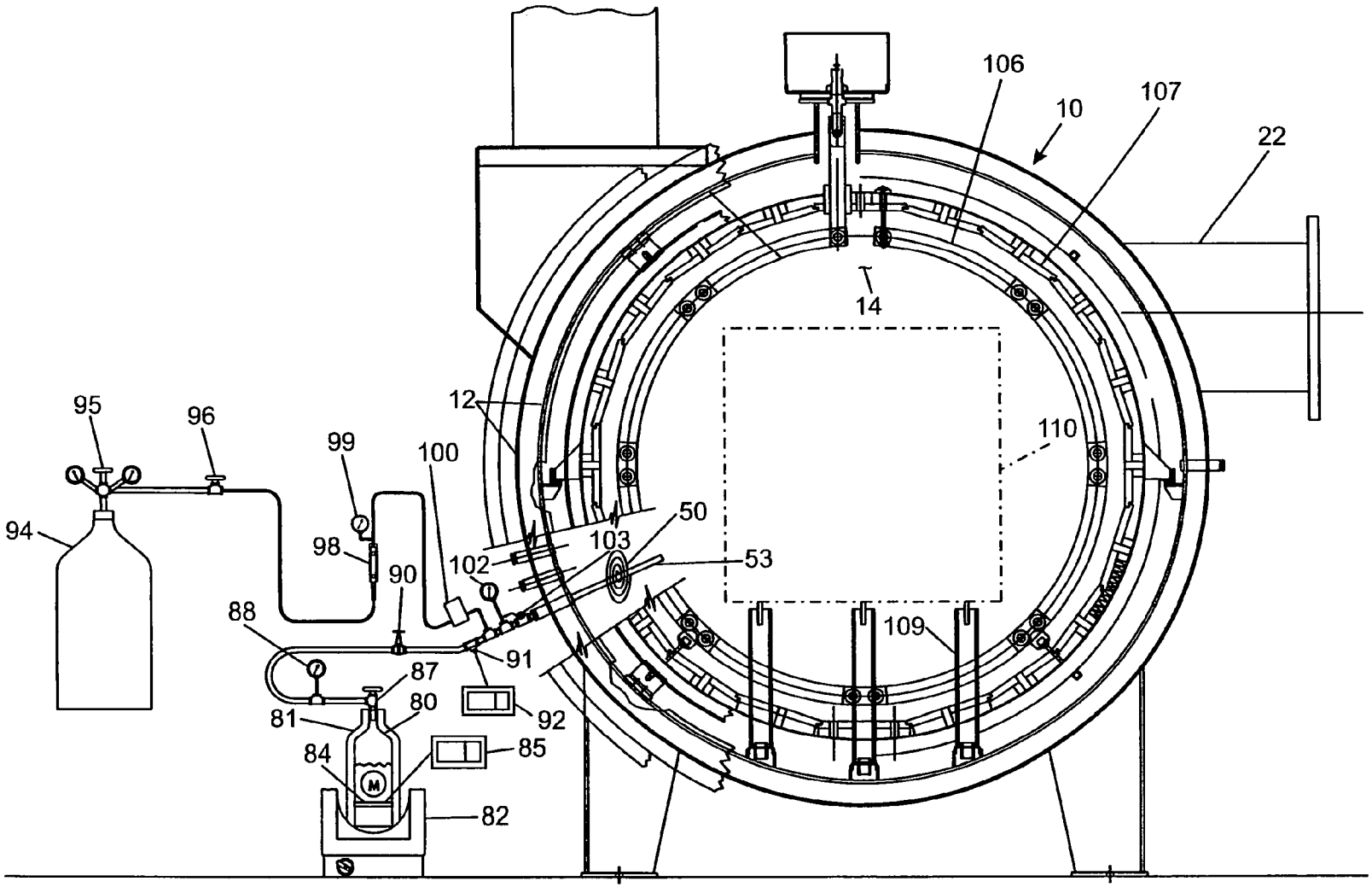
FIG. 5 is a cross-sectional view of an electrically heated cold wall vacuum furnace illustrating a gas injection of carburizing gas of the present invention.

Referring now to FIG. 5, there is shown one embodiment of the invention illustrating one way to meter unsaturated aromatic as a gas to hydrogenation coil 50. In the embodiment of FIG. 5, an unsaturated aromatic (or a blend of unsaturated aromatics) in liquid form is placed in a tank 80 that is insulated as at 81 and tank 80 is placed in a vaporizer heating source 82 which preferably, is an adjustable electric heater. In the vaporizer is a tank thermocouple and clamp 84 with a temperature readout indicator designated by reference numeral 85. There is a tank shut-off valve 87 and downstream therefrom, a tank pressure gauge 88 and downstream thereof, a mass flow control valve 90. Downstream of mass flow control valve 90 is a mass flow thermocouple 91 connected to a temperature readout device indicated by reference numeral 92. Between mass flow thermocouple 91 and mass flow control valve 90, the ⅜" steel tubing is wrapped in a high density heat tracing tape and between mass flow control valve 90 and tank shutoff valve 87, the ⅜" stainless steel tubing is wrapped in a low density heat trace tape.

There is also provided a hydrogen supply cylinder 94 containing gaseous hydrogen. Mounted to hydrogen cylinder 94 is a hydrogen pressure regulator 95 and downstream therefrom is a first hydrogen flow control valve 96. Downstream therefrom is a hydrogen flow meter 98, a hydrogen flow meter pressure gauge 99, and downstream of pressure gauge 99 is a hydrogen mass flow controller 100. The hydrogen is then T'd into the aromatic line and downstream of the hydrogen "T" is a pressure gauge 102 (zero to 30 inches vacuum) and a manual shut-off valve 103. The aromatic gas line then passes through furnace casing 12 where it is sealed vacuum tight with a hydrogenation coil 50 followed by lance 53 where the gas is metered into furnace chamber proper 14.

Furnace chamber 14 has electric heating elements 106 and is of a cold wall design with furnace insulation 107 pinned to inner chamber housing. The furnace insulation in this type of furnace is only about 3" thick. Hydrogenation coil 50, positioned within furnace insulation 107 has a pancake, spiral configuration termed a "level wound" coil. It is depicted schematically in FIG. 5 as a spiral. Also shown in FIG. 8 are hearth supports 109 which support the work typically placed as loose pieces in a work basket or tray indicated by dot-dash line 110.

In operation of this system, it should be noted that benzene boils at about 176° F. but since pressure in tank 80 is about 20 psig to 40 psig, temperatures up to 200 to 220° F. are acceptable. Higher temperatures are required for other unsaturated aromatics that have higher boiling temperatures, i.e., toluene (231° F.), o-xylene (291° F.), m-xylene (282° F.), p-xylene (281° F.) and ethyl benzene (277° F.). The aromatic cylinder 80 is an aluminum gas cylinder about 4" in diameter and 16" high with shut off valve 87. The cylinder is intended to be used as a gas cylinder under pressure. About 2.5" off the bottom, a thermocouple 84 is attached with a hose clamp. Tank temperature is kept above 200° F. and always under 250° F. for benzene and tank temperature is adjusted to keep outlet pressure around 20 to 22 psig and never over 40 psig. The cylinder was filled with various amounts of liquid from 500 ml to 1900 ml. The liquid level did not have any influence on tank temperature and pressure unless the tank was running out of benzene. The remainder of liquid in tank 80 after testing was used to determine usage. If 480 ml of liquid was used in sixty minutes, it was concluded that the tank delivered 105 liters of gas vapor (multiple ml times 0.220 to get liters of gas vapor). Therefore in one hour, 105 liters divided by 60 minutes established a gas flow rate equivalent to 1.76 l/m.

The tank, once filled, was charged with nitrogen to 20 psig, and recharged five times after venting to flush oxygen from the tank. Tank pressure limits were 50 psig absolute maximum and a minimum was set at 17 or 18 psig. Typically tank pressure is between 20 to 22 psig once the nitrogen is bled off. With the nitrogen charge, tank pressure is around 40 psi initially at temperature.

The tank was covered with Kaowool insulation 81 to keep in heat, and heater was set to thermocouple reading 85 and pressure gauge reading 88. Once stabilized, temperature and pressure remained constant.

Typically, the vaporizer was actuated 30 to 60 minutes before needed for carburizing. The $N_2$ is bled off early on while the load was still cool. In commercial production, tank 80 would be charged with argon to be 100% sure no nitriding could take place. It is believed the $N_2$ is inert and is lost early on and does not at all influence the hydrocarbon. However, at 1900° F. and above there is some remote possibility of nitriding.

The piping from the cylinder was ⅜" stainless and was heat traced with two different heat tapes. The tape up to the flow control valve 90 was 4' long and covered a long distance. The heat tape down stream of the micro flow control valve 90 was 24" long and covered a short distance and was packed tighter. This last area caused great falls in temperature when flowing vapor. For example, an up steam gas vapor of 245° F. could plunge in a couple a seconds to 40° F. Thus, the freeze point of the aromatics has to be accounted for. One way to do this is to make a blend of unsaturated aromatics which will not freeze at the temperature drops noted.

Control of flow is obtained by watching the temperature of thermocouple 91 at readout 92. The gas vapor before control valve 90 is around 230° F. due to vaporizer heat and heat tape. Once passing through control valve 90, the temperature dropped as a function of flow. The greater the flow, the lower the temperature. Typically, flow control valve 90 is adjusted to about 195° F. and more flow is added if the temperature went over 210° F. and closed down if the temperature dropped under 190° F. or so. In the beginning of the testing, the flow control valve was constantly adjusted in response to any variation. Later on, the valve was left set unless temperature trended up or trended down.

After processing, the balance of the liquid is measured to determine flow rate and later to assure flow rates were correct.

2) The Liquid "Fuel Injection" System.

Figure 6A:
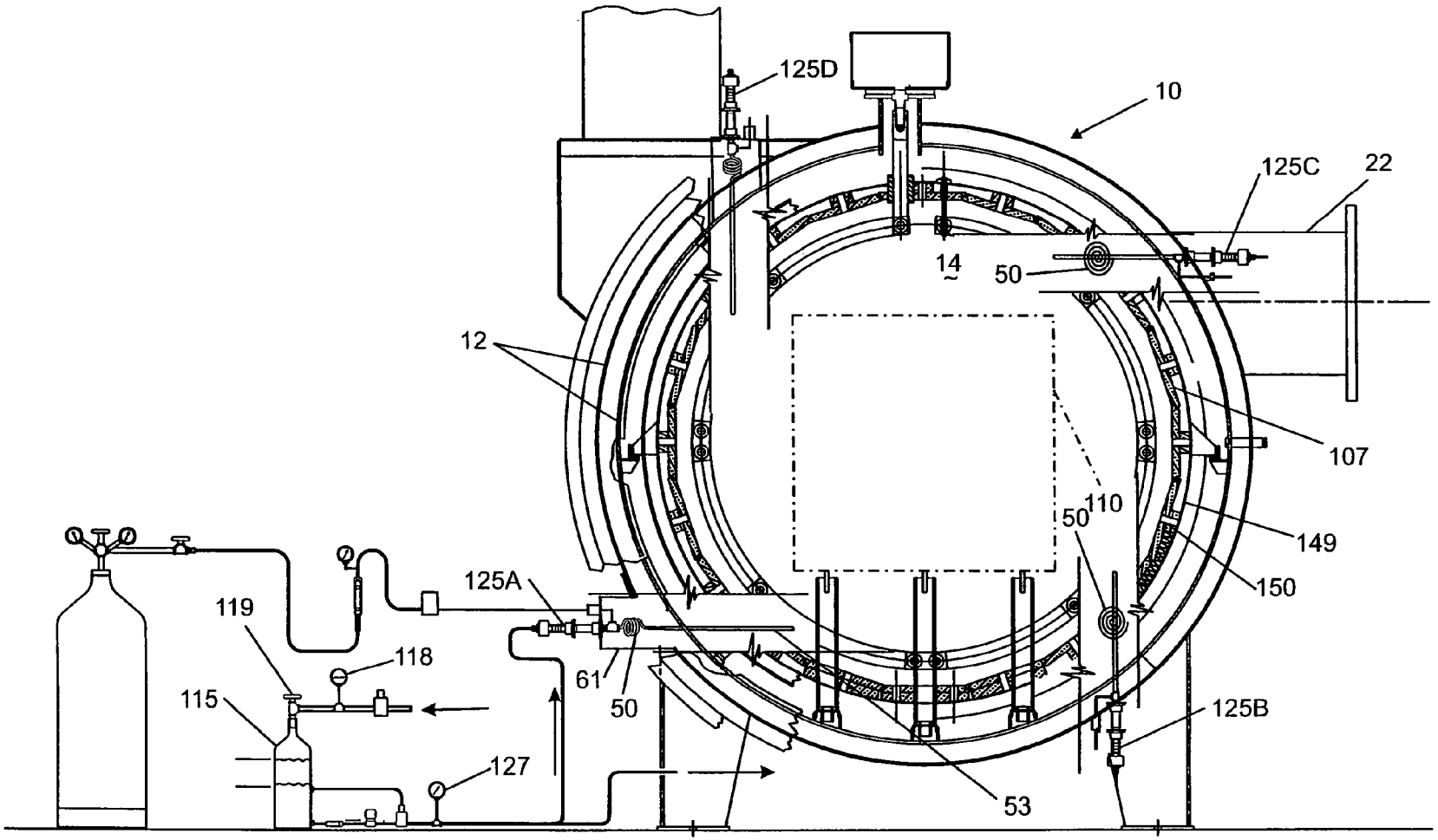
FIG. 6A is an expanded schematic view of the liquid injection system illustrated in FIG. 6.
Figure 6B:
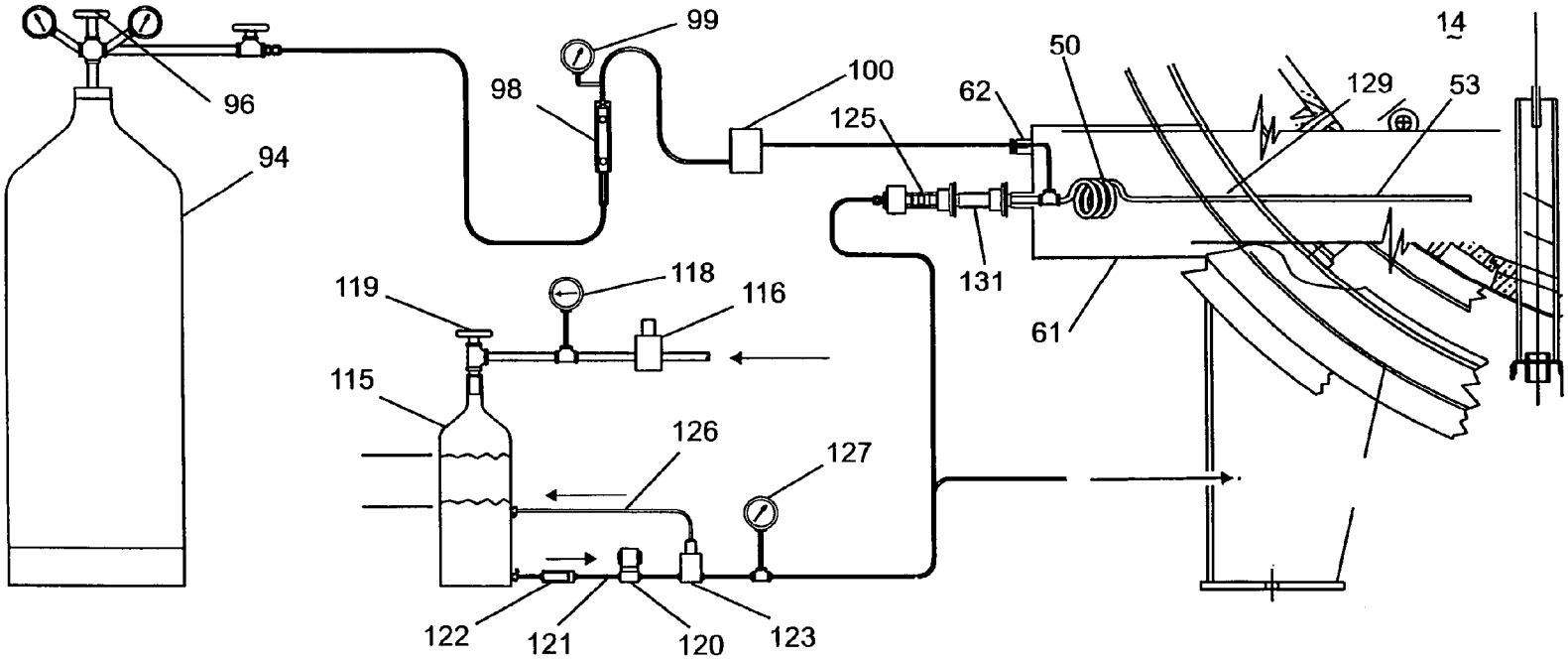
FIG. 6B is an expanded view of the first injector assembly illustrated in FIG. 6.
Figure 6C:
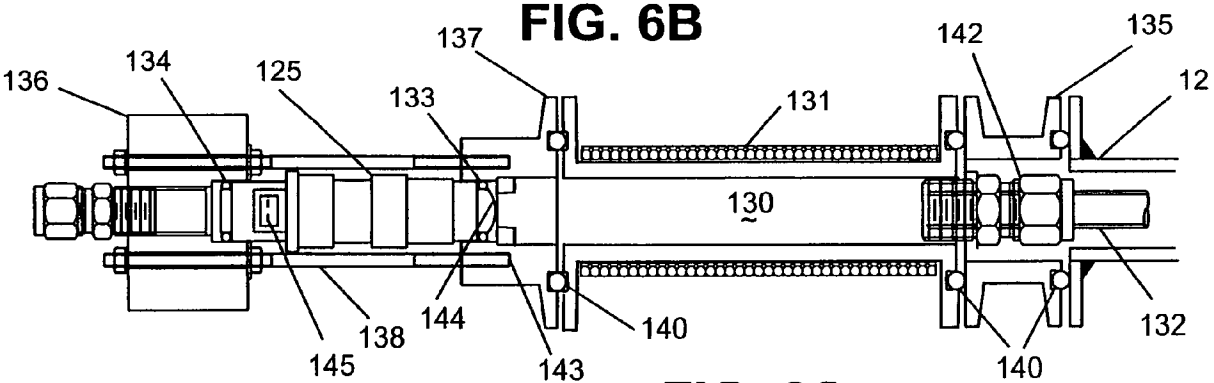
FIG. 6 is an illustration of a cross-section of the vacuum furnace illustrated in FIG. 5 but modified to illustrate injection of the carburizing medium in liquid form to the carburizing furnace.

Referring now to FIGS. 6, 6A and 6B, there is shown an aromatic liquid delivery system. Because many gases used in heat treat processing are supplied in bottled liquid form, there can be a semantical question as to the meaning of a liquid delivery system since the inventive liquid delivery system delivers the hydrocarbon as a vapor in furnace chamber 14. Therefore, as used herein, liquid delivery system means that the carburizing medium in a liquid hydrocarbon form is metered as a liquid to the furnace chamber and remains as a liquid throughout the delivery system up to a point or a position which can be defined as being adjacent to the furnace casing. According to this definition, the vaporization of the liquid hydrocarbon to a gaseous hydrocarbon can occur either on the inside of the furnace casing or at a point adjacent the outside of the furnace casing. The flow of the carburizing medium to the furnace is controlled with the carburizing medium in a liquid form. This distinguishes from the prior art which uses bottled gas supplied in liquid form because the liquid when leaving the bottle is a gas which is remote from the furnace and the gas is regulated, typically by a simple mechanical flow meter. This also distinguishes from some plasma applications which literally pulse the gas to be ionized into the furnace chamber by solenoid actuated valves. The solenoid valves control a gas and not a liquid.

In FIG. 6, and as best shown in FIG. 6A, commercial grade benzene or other unsaturated aromatic liquid is poured into a hydrocarbon cylinder 115 until it is full, indicated by the top line shown in the drawing (with the bottom line indicating the minimum hydrocarbon level or an empty bottle). Hydrocarbon cylinder 115 is pressurized by a blanket of inert gas such as nitrogen or, preferably argon if potential nitriding at higher carburizing temperatures is a concern. The inert gas is supplied to a pressure regulator 116 typically having an inlet pressure of 150 psig and an outlet pressure of 2 psig. The inert gas passes by a pressure gauge 118 (0 to 10 psig) through a shut-off valve 119 to provide a gas blanket on top of the liquid hydrocarbon in hydrocarbon cylinder 115 at a slight pressure. An inert gas pressure relief valve may also be fitted to the tank in the event the inert gas regulator is defective. A pump 120 draws liquid hydrocarbon out of hydrocarbon cylinder 115 through an outlet line 121 at the bottom of hydrocarbon cylinder 115, the liquid passing through a fuel filter 122 before reaching pump 120. A three-way Mallory pressure regulator 123 or equal make or design downstream of fuel pump 122 directs liquid hydrocarbon to a fuel injector 125 (or a plurality of fuel injectors) or to a return line 126. A 0 to 5 bar pressure gauge 127 is provided for verification and control purposes.

In this embodiment, hydrocarbon cylinder 115 is not excessively pressurized by the blanket gas (nitrogen or argon) which is under 14.7 psig. The purpose of the blanket gas is to keep air and moisture out of the system. The inert gas does this and also makes the cylinder safe. Because pressure is less than 14.7 psig, cylinder 115 does not need to be an ASME pressure coded storage tank. Also, pressure regulator 123 is downstream pressure compensated and delivers constant flow at 10, 20, 30 torr, etc. The embodiment depicted in FIG. 6 is preferred as the delivery system for multiple vacuum furnace applications. However, the FIG. 6 embodiment does require a pump and a by-pass. An alternative simpler arrangement is to eliminate pump 120, by-pass line 126 and replace Mallory regulator 123 with a two-way regulator such as shown at reference numeral 116. The pressure of the blanket gas is then increased and supplies the pressure to the liquid valved to injector 125. Setting the 2-way regulator to 11 psig produces a differential pressure of 25.7 psi across injector 125 which is perfectly acceptable for the pressures at which the furnace operates and allows the blanket gas to be charged into hydrocarbon cylinder 115 at less than 14.7 psig so that the cylinder need not be a pressure codified cylinder while still retaining the safety benefits of an inert gas. There may be a slight variation in pressure of cylinder 115 as the liquid hydrocarbon is depleted but in practice this has not been observed to produce any detrimental results. Pressure variations may be minimized by orientating the cylindrical tank horizontally. If the fuel output range of injector 125, which is 5 to 50 psig, is to be fully utilized, an ASME pressurized certified cylinder 115 is required for this alternative embodiment. In either embodiment, the liquid aromatic without air or moisture is supplied at a set pressure to fuel injector 125 which injects liquid pulses of the aromatic that vaporize into gas. It should be noted that injector 125 allows vaporization of the aromatic (vacuum) without additional heating. For example, in the gas metering system discussed above, xylene would require the vaporizer to run at 300° F.

For metering hydrogen, an arrangement similar to that used for hydrogen as shown in FIG. 5 is employed and reference numerals used with respect to FIG. 5 will apply with respect to the liquid injection delivery system shown in FIGS. 6 and 6A. More particularly, there is a hydrogen supply cylinder 94 which meters gaseous hydrogen at a set pressure as controlled by hydrogen pressure regulator 95 and generally at a set flow as controlled by hydrogen mass flow controller 100. Downstream of the regulator and the valves is hydrogen flow meter 98 and hydrogen flow meter pressure gauge 99 and mass flow controller 100 closely regulates the flow of hydrogen.

In FIGS. 6 and 6A, for conceptual discussion purposes, a duct 61 is constructed from the inner casing for mounting fuel injector 125 with a conventional hydrogenation coil 50, such as illustrated in FIG. 2. Duct 61 is conceptually similar to auxiliary vacuum duct 41 shown in FIG. 1 and its length, insulation and possible external heating source (i.e., resistance heating elements can be employed if necessary) are selected depending on the application. For example, a cold wall, water jacketed vacuum furnace without insulation would utilize structure similar to duct 41. Because vacuum furnace 10 depicted in FIG. 6 has furnace insulation, two of the injectors, 125B and 125C are equipped with level wound coils and two of the injectors, 125A and 125D are equipped with duct 61 for discussion purposes. In either arrangement, it is preferred that T connection 54 be positioned inside the furnace casing or inner liner as shown and a vacuum tight fitting 62 is provided for the hydrogen line.

As best shown in FIG. 6B, fuel injector 125 is supported between front and rear O-rings 133, 134 which are mounted in bored and polished holes formed in a rear adapter plate 136 and a front adapter flange 137, respectively. Three threaded rods 138 secure the rear adapter plate to front adapter flange 137. Front adapter flange mounts to expansion chamber 130 which, in turn, mounts to a furnace adapter 135 which, in turn, mounts to a flange fitted to furnace casing 52 or duct 61. Several clam-shell clamps (not shown) compress an O-ring 140 to provide a vacuum tight seal between front adapter flange 137, expansion chamber 130, furnace adapter 135 and furnace casing 140. A special ⅜" Swageloc fitting 142 provides a true sealing fit for lance 53 In the prototype, electrical connectors 145 are wired to gating transistors on a timing circuit for controlling pulsing of fuel injector 125.

Some additional comments are necessary. In the prototype there is a runner between front flange 137 and furnace adapter 135 which is designated a KF runner or fitting. This KF fitting is the expansion chamber 130 and mounts to the injector as described. The vaporization of the liquid hydrocarbon to gas causes a drop in temperature. The runner or expansion chamber is sized to allow about a 5 to 1 expansion from liquid to gas. It can be a short as about 4" and as long as desired. The prototype had a diameter of about 0.9" and a length of about 12". The runner or expansion chamber 130 is covered with a heat tape 131 not only to prevent freezing for some of the hydrocarbons but also to simply insure that the vapor of the hydrocarbon stays as a vapor. Note that expansion chamber 130 is outside furnace casing 12. This is preferred but not necessary and an arrangement can be used where the expansion chamber 130 can be positioned within the furnace, i.e., the furnace wall. Again, the size of expansion chamber 130 is calculated to be sufficient to allow the largest injected pulse to vaporize.

The prototype system used a GM Corvette fuel injector taken from service and has worked without problems carburizing a number of workpieces between 1600° F. and 1800° F. with most of the runs at 1700° F. and 1750° F. Liquid flows were initially based on 35 millisecond pulses gated every second and 70 millisecond pulses gated every second. The gas usage repeats extremely close cycle after cycle with the 70 millisecond pulse consuming exactly double that of the 35 millisecond pulse. Timed electrical outputs were calibrated for the prototype on an oscilloscope. Production versions will have high speed clocks using the microprocessor. The 35 milliseconds per second pulse consumed about 5.6 cc of aromatic liquid each minute or 336 cc per hour. The liquid usage equates to a gas vapor flow rate of 1.23 liters per minute. Likewise, the 70 ms pulse consumed about 11 cc of aromatic liquid per minute or 672 cc per hour for a gas vapor flow rate of 2.46 liters per minute. Total consumption was about 1,480 cc for 2¼ hour carburizing runs. Delivery pressure is typically set at 11 psig. The injector is designed for upwards of 50 psig and normally runs in the 35-42 psig range for automotive applications. Also, the injector can run up to 800 ms before reaching about 80% maximum duty cycle so that the 70 ms cycle is only about a 9% duty cycle. For purposes of this invention, an injector which can vary its pulse width of anywhere from about 5 milliseconds to 700 milliseconds at injection pressures of about 5 to 50 psig is believed acceptable. If necessary, larger and smaller injectors are commercially and readily available should there be substantial increases or decreases in flow requirements. The injector, being designed for automotive vehicular application has not developed any leaks, nor have the O-rings experienced softening or swelling when submerged in 100% cyclohexane or toluene for twelve months. Since the automotive O-rings are providing sufficient service, no further investigation into the sealing capabilities of the fuel injector is planned.

Figure 7:
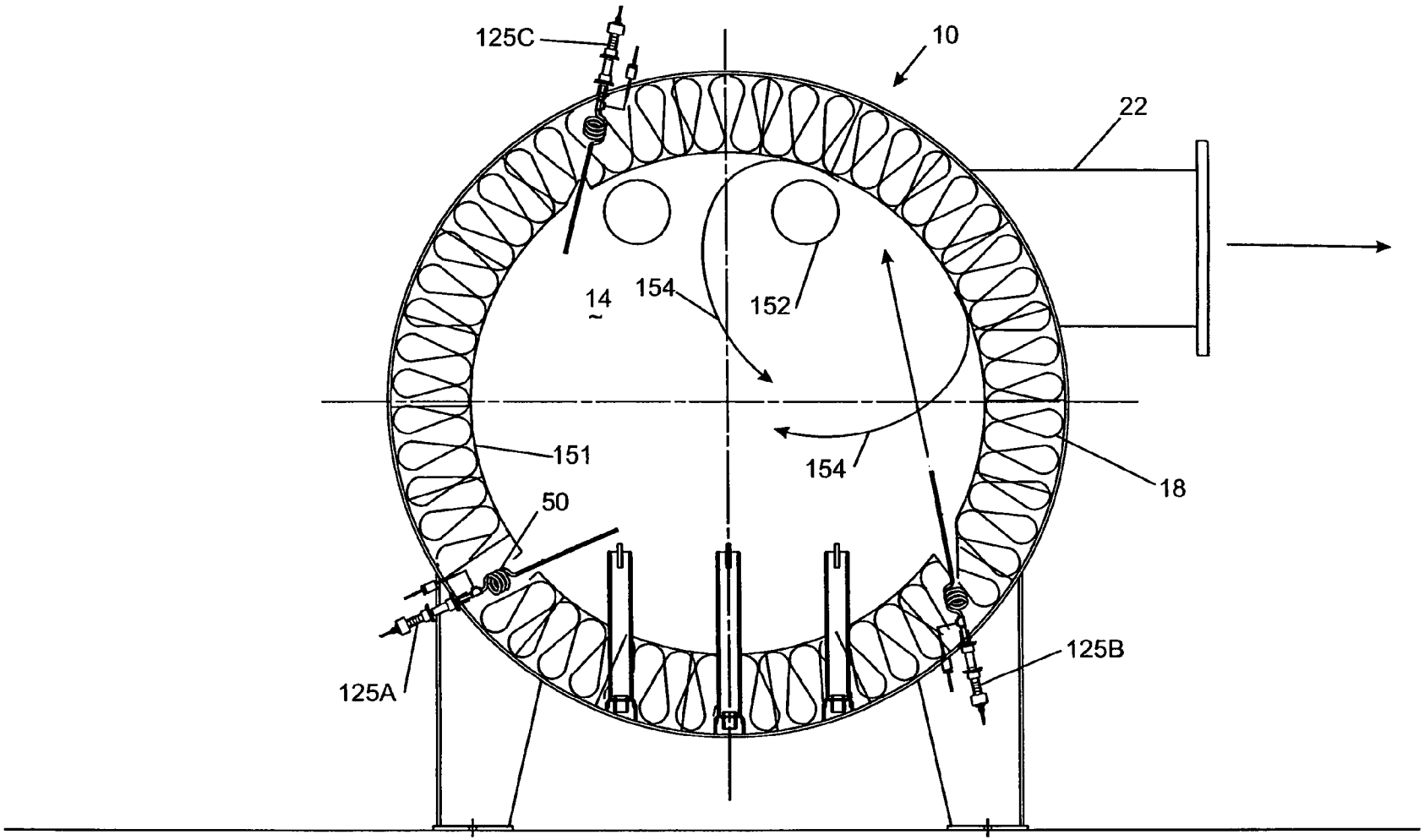
FIG. 7 is a cross-sectional view of a gas fired hot walled vacuum furnace modified to accommodate the liquid fuel injectors of the present invention.

Referring still to FIGS. 6-C and also as shown in FIGS. 7 and 8, vacuum furnace chamber proper 14 is provided with multiple fuel injectors, there being 4 fuel injectors designated 125A, 125B, 125C and 125D shown in FIG. 8. In FIG. 7, there are three fuel injectors 125A-125C angled in a desired configuration and in FIG. 8, there are deflecting radiation shields and injectors 125A-125D are shown mounted therein for drawing clarity purposes without the presence of a duct (which is otherwise required because furnace insulation is not shown for this water jacketed vacuum furnace 10). With regard to the positioning of the injectors, it was originally felt that 4 or more injectors would be mounted tangentially with smaller furnaces being equipped with two injectors. The injectors would fire in a clockwise pattern or counter-clockwise and create a variation in the atmosphere for a given part and the atmosphere for the carburizing gas would move to the parts for carburizing. It is now strongly believed that the injectors should be mounted with their outlets above or below the load and strike a transparent target. The momentum of the pulse will then push or deflect or reflect the gas toward the load but the gas would be diffused. The transparent target can be the radiation shields of FIG. 9 or the round furnace wall of FIG. 8 which can produce a parabolic deflection back to the work as indicated by the flow arrows. It is to be appreciated that the pulse from the injector first passes through hydrogenation coil 50 where it is mixed with hydrogen and there is some tendency to dampen the pulse as a result of the mixing. However, the pulse is clearly not diminished and the hydrogenated aromatic passes as a pulse of naphthenes into the furnace chamber proper.

The prior art (excluding, of course, ion carburizing) has attempted to improve the flow of the carburizing gas over the workpieces by installing multiple gas inlet ports. The multiple gas inlet ports deliver a continuous flow of gas which is trying to find its way to the vacuum pump. In its effort to find the vacuum pump exit, carburizing gas, by coincidence, comes into contact with the load to be carburized. However, even with multiple gas inlet ports, the gas, in all probability, will tend to pass by certain parts or surfaces of certain parts more often than others so that the net result is a variation in case in the carburized load. Within conventional gas carburizing art, a circulation fan is typically installed for the purpose of mixing carrier gas and enriching gas uniformly and causing this mixed gas to pass as much of the load surface area as possible to improve on case penetration and overall uniformity. In a vacuum furnace, a fan is not possible since the amount of gas at typical vacuum furnace pressures of 10 torr is negligible. There is nothing to circulate. Also, fan motors do not operate in a vacuum due to arcing of the electrical windings.

Using multiple fuel injectors as disclosed in this invention can address this problem because the injector sequencing can be varied to create a higher degree of randomness or disorder. Therefore, due to the random nature of the variation in the injector sequencing pattern, those sections of the work which otherwise might have been deprived of carburizing gas due to the predictability of a given flow pattern, can now be exposed to the gas.

More particularly, the injector pattern for a given injector would repeatably fire for as short as 10 seconds and as long as 10 minutes before passing over to the next injector. Better yet, the injector would fire for 30 seconds to 5 minutes before passing over to the next injector, and better yet the injector would fire for 1 to 2 minutes before passing over to the next injector. The pattern for the first sequence would be 1, 2, 3, 4. For the second sequence, 1, 3, 2, 4. For the third sequence, the pattern could be 1, 4, 3, 2. Likewise, for the fourth sequence, the pattern could be 1, 2, 4, 3. The firing sequence is not limited to the patterns described, which are listed only for the purpose of explanation.

As a further extension to the creation of a random flow of gas throughout the work, the injector has the ability of varying its pulse width. The longer the pulse width, the greater the force of impact on the target. Changing the point of impact changes again the randomness of the initiation of the gas burst. Likewise, the short duration pulses may not at all even strike the target and therefore generate yet another propagation point of the gas. The injector pattern on low duration pulses tends to be soft and diffused. The injector pattern when striking a target with a very long pulse width creates a harsh reflection with rippling patterns of greater circumference than those of the shorter pulse.

Therefore, randomness or disorder in the delivery can be assured by not only changing the sequence for the firing of the injectors but also for the duration during which the injectors fire and before switching over to another injector in the firing order. For example, assume that an average 50 millisecond pulse is to be produced for a given injector every second. Injector 1 fires 5 milliseconds and does not strike the target for a period of 30 seconds. At the end of the 30 seconds, the injector fires at 95 milliseconds for 30 seconds. The average pulse width at the conclusion of 60 seconds is still 50 milliseconds per second so the correct amount of gas has been injected. For the next period of 30 seconds, the injector fires at 20 milliseconds followed by a 30 second period of 80 milliseconds. The third minute of operation of the injector could be simply 50 milliseconds. During this time period the gas does not reach the target and then reaches the target harshly. During the 50 millisecond pulse, the target is reached but not as harshly as that when the pulse width of the injector was at 80 milliseconds. Note that while this technique is in operation for injector 1, alternate patterns are about to happen on injectors 2, 3 and 4. At the end of 5 minutes, the total gas injected into the furnace is the same as if the injector was operating at steady state.

The controller can easily implement the variations described above once the operator sets a set flow point in the controller. The controller for the system creates the variations in flow and generates the random flow patterns. It is to be understood that while all of the metering valves and gauges shown in the furnace drawings visually depict manual type devices, the gauges are sending signals to a master controller such as the DataVac controller 40 or to a specific controller such as PID loop controller 29 and the controller in turn, is outputting command signal to actuators which control the valves or set the injection pulses. As is well known in the control art, the master controller can send the command signal directly to the actuator controlling a valve or the command signal can be sent to a dedicated controller which in turn, will generate the actuator output signal.

The liquid fuel injectors of the present invention overcome this problem and can be used with any hydrocarbon in liquid form and not just with the cyclic hydrocarbons of the present invention. Basically, the liquid and thus the vaporized gas, is injected into the furnace chamber with a momentum which controls the flow of the gas through the vacuum exhaust. By changing the momentum during the carburizing process, the path that the carburizing gas takes can be varied in a manner to insure that all parts and all part surfaces are exposed to carburizing gas flow and thus are uniformly carburized.

E. Furnace Construction/Insulation.

FIG. 6 shows a conventional cold wall vacuum furnace with insulation provided as boards 107 fitted together as illustrated and secured to the interior of inner chamber frame or housing 149 by studs indicated generally by reference numeral 150. In the FIG. 6 embodiment, the fuel injectors 125A-125D are mounted tangentially and will produce a clockwise or counterclockwise flow. For reasons discussed above, this is not especially preferred. However, by varying injection timing and pulse width, the gas momentum can be varied to achieve better dispersion of the gas through the work than is possible with multiple gas nozzles.

FIG. 7 is a hot wall furnace and insulation is of a blanket type 18 on a board/blanket combination. More particularly, the insulation is a vacuum-form ceramic fiber insulation of a relatively high density (10-15 lbs/ft$^3$) with thickness as high as 12" as mentioned above. The surface of the insulation is sprayed with a conventional silica sand mixture, i.e., Kaowool rigidizer, which makes it hard and rigid. The insulation is formed into pre-shaped blocks individually secured to the casing by studs (not shown) fitted together like pieces of a jig-saw puzzle into a tight compressive contact with one another which, when sprayed with the rigidizer, reduces gas infiltration therethrough and resists erosion during gas quenching (if the furnace is equipped with a gas quench).

Vacuum furnace 10 illustrated in FIG. 7 is also provided with gas fired radiant heating tubes schematically indicated by reference numeral 152. In the furnace of FIG. 7, three circumferentially spaced injectors 125A-125C are orientated as shown so that the gas vapor will impact rigidizing skin 151 and assume the flow direction indicated by arrows designated by reference numeral 154 during one part of the injection cycle. It is to be noted that the discussion of vacuum furnace application centers about the workpieces being placed loose in trays moved into and out of furnace chamber proper 14 which is the procedure typically followed by commercial heat treaters. For captive applications which involve carburizing one particular workpiece, the workpiece may be fixtured and set in a fixed position in furnace chamber proper 14. For those applications the diffusion pattern discussed above can be set to be especially effective. However, it may be possible to place lances with shaped outlets to directly impinge the entire surface area. In this regard, the lance(s) could be automated to telescope between fixtured workpieces to assure a specific position.

FIG. 8 illustrates a cold wall design furnace wherein a water jacket 156 exists between inner and outer furnace casings. In a cold wall vacuum furnace, multiple radiation shields 157 typically provide a box-like enclosure or inner liner in which the work tray is placed. Positioned within the inner liner are electric heating elements 158. Heat from heating elements 158 is radiated by radiation shields 157 to the work. The radiation shields or inner liner are welded together into the box like inner liner construction but are not vacuum tight.

In the discussion above, it was mentioned that iron acted as a catalyst speeding the cracking reaction of the cyclic hydrocarbon gases. Conceptually, it is desired that vacuum furnace 10, specifically the vacuum furnace structure defining furnace chamber 14, be inert or transparent with respect to its ability to cause a catalytic reaction with the cyclic hydrocarbon carburizing gases. It has been determined that the cyclic hydrocarbons, particularly the 5 and 6 carbon sided rings of the preferred embodiment, do not form any reaction with graphite. The furnace illustrated in FIG. 8 has graphite insulation with a graphite foil cover. No carbon drop-out was observed on the graphite board. The heating elements were graphite and were bright in appearance following the carburizing cycles. In fact, graphite boards that have been placed in the furnace chamber after the end of a carburizing cycle, have been scrubbed with a wet white paper towel with virtually low or no carbon pick-up. Typically, just touching a graphite board in a carburizing furnace using conventional carburizing gases leaves carbon on one's fingers.

Ceramic insulation, however, made from aluminum and silica, appears to breakdown the gas. In accordance with the invention, it is preferred that when using aluminum and silica insulation in the vacuum furnace, the insulation should normally be covered either by a graphite paint which can be painted, rolled or sprayed, or by a graphite foil covering the aluminum and silica ceramics. At the same time, it was discovered that aluminum silica ceramic insulation, over time, acquired a graphite-type or graphite like coating which made the insulation somewhat transparent to the gas, resulting in little carbon drop-out. Accordingly, it may be possible to purposely develop a graphite type or protective coating on an alumina and silica ceramic furnace insulation by running the naphthenes in the furnace for a couple of days. However, tests of durability of the coating have not been run as of the date of this invention. The graphite coating does appear to be uniformly deposited over all the insulation in the furnace. It is uncertain whether the graphite coating can withstand the fan flows in the furnace chamber when quenching at high pressures with inert gases. For the radiant tube application, conventional high alloy radiant tubes may be used (protective graphite type seal formed), however, silicon carbide tubes now being developed for high temperature applications of radiant tubes are completely transparent to the carburizing gas and can be employed. It must be noted that hot wall gas fired vacuum furnaces do not have the concern over carbon deposition that electric cold wall furnaces have. Carbon deposits in cold wall electric furnaces can ground the heating elements leading to an inoperable furnace. So long as tar is not formed in the hot wall gas fired furnace design, carbon deposits are not of serious concern. Also, the cylindrical configuration of the furnace casing with interior insulation allows for better temperature uniformity throughout the furnace chamber. Finally, cast alloy radiant tubes were used in the prototype furnace. Carbon dust was found over the tubes, as expected but the dust did not have any effect on the carburizing process. Accordingly, when used herein, the terminology of "transparent" or "substantially inert" with respect to the cracking reaction which can occur with the naphthenes carburizing gas, means or includes materials that otherwise would react with the naphthenes in their native form, but which have acquired a graphitic like coating which tends to make them inert.

With respect to the radiation shield inner lining 157 of the cold wall vacuum furnace, it was found that the molybdenum liners were somewhat transparent to the gas. Transparency is believed established because the liners were clean after carburizing. The molybdenum liners had no iron. It is believed that molybdenum radiation shields should not have an iron content greater than 5% when used with the invention. It has also been discovered that moly-nickel alloy with less than 5% Fe balance appears transparent to the naphthenes gas despite the presence of nickel. This alloy has traditionally not been used as a radiation shield, but it is available in thin section suitable for radiation shield design. Please note that the steel casing surrounding the radiation shield in the cold wall furnace is at a temperature as high as 400° F. and depends on the amount of insulation used and operating temperature. The cyclic hydrocarbon gases are not reactive at this temperature. Thus, no precaution is needed for the cold wall vacuum furnace other than the selection of the material for the radiation shields and the use of graphite heating elements instead of metal resistance heating elements.

Figures 8A, 8B:
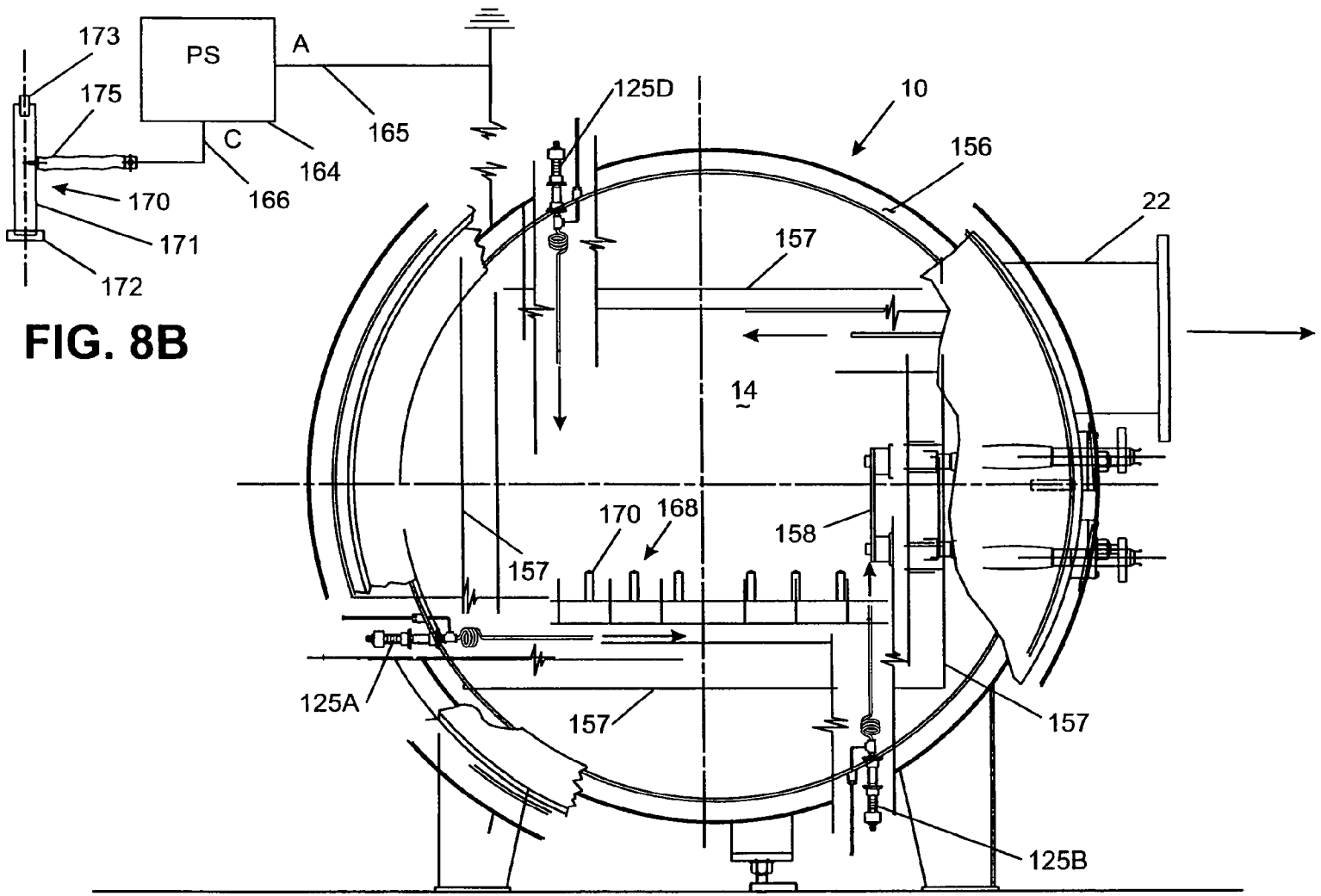
FIG. 8A is a schematic depiction of a furnace construction detail for a vacuum ion carburizing furnace practicing the invention.

Some preferred modifications are required when the invention is used in a vacuum ion (glow discharge) furnace and this is shown in FIG. 8A which conceptually illustrates a modification to vacuum furnace 50 of FIG. 8 by applying a glow discharge, ion power supply 164. Power supply 164 ionizes the carburizing gas by creating electrical potential between anode 165 which is ground established by the furnace casing and cathode 166 which is the workpiece. Electrical contact for the cathode is established from the work which as noted lie on a tray which in turn rests on a furnace hearth designated by reference arrow 168 in FIG. 8. Hearth 168 is comprised of a plurality of hearth supports, one of which, hearth support 170, is connected to power supply 164 as shown in FIG. 8 A. Hearth support 170 comprises a graphite post 171 which is journaled at its bottom in a ceramic insulator 172 which in turn is vacuum sealed to the inner furnace casing. At the top of post 171 is a silicon carbide rail 173 which spans several posts and serves as an electrically conductive support for the workpiece tray. Attached to post 171 is an electrical cable (copper) 175, preferably within a graphite coated shield (not shown) which in turn is connected to a feed through (not shown) which extends through (vacuum tight) the inner and outer furnace casings forming water jacket 156. Alternatively, copper cable 175 could be connected to post 171 in the vicinity of insulator 172 where the water jacket reduces temperature. The feed through is at the cold wall so no gas protection substance is needed. However, the rest of the hearth is electrically conductive but essentially transparent to causing catalytic cracking reaction with the carburizing gas. Reference can be had to U.S. Pat. No. 5,127,967 to Verhoffet al. entitled "Ion Carburizing" issued Jul. 7, 1992 incorporated herein by reference for its description of power supply 164 and hearth connections thereto which will not be discussed further.

It is also noted that the lance for fuel injectors 125 is made out of stainless steel and have remained repeatedly clean and bright during operation. As noted above, because stainless steel has an iron composition, the lance can act to hydrogenate the unsaturated aromatic as well as hydrogenation coil 50.

F. Example.

Figure 9:
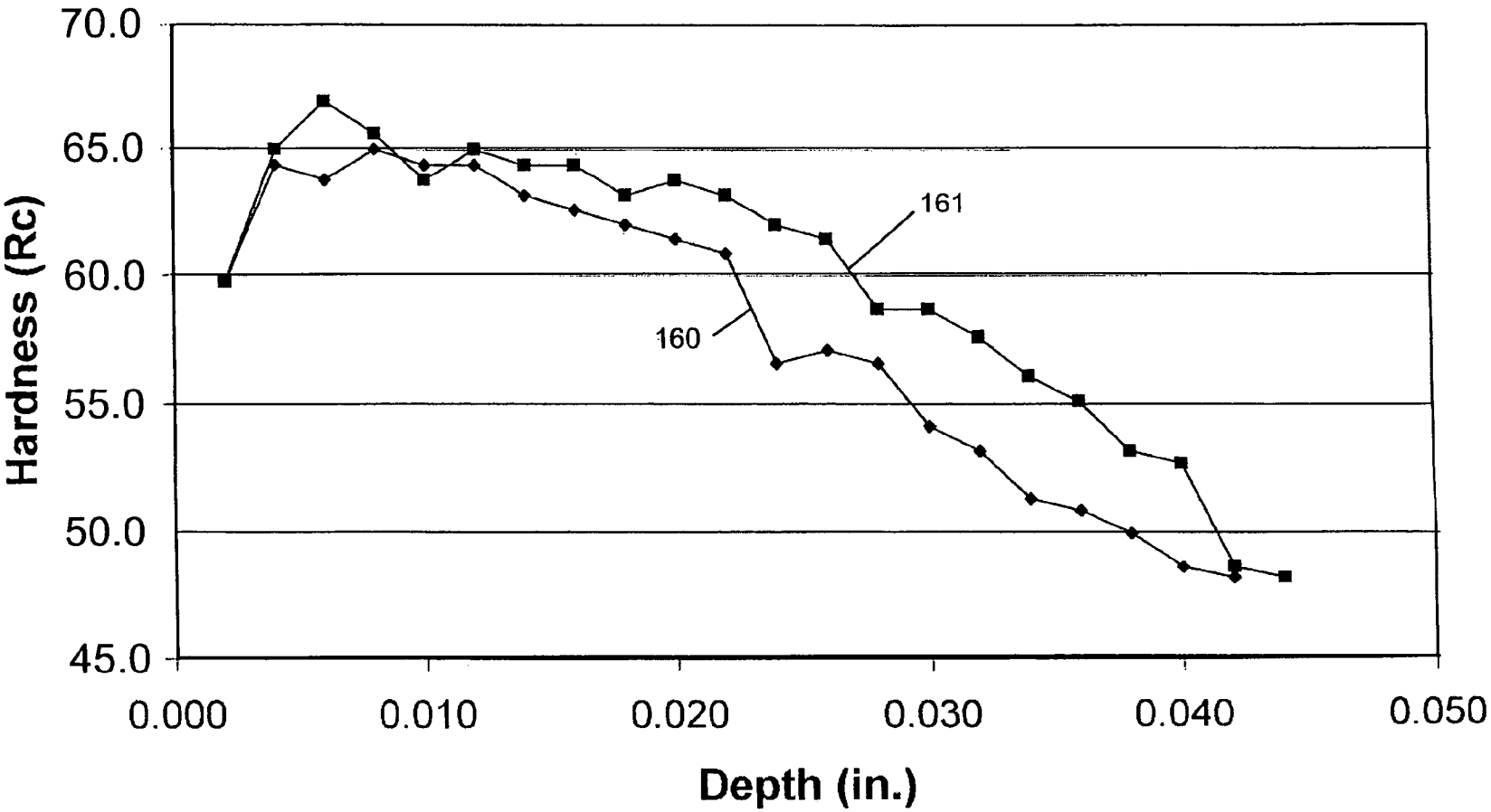
FIG. 9 is a graph showing carburized case depth hardness readings at the root and pitch diameters of a gear tooth carburized in accordance with the vacuum carburizing concepts of the present invention.
Figure 11:
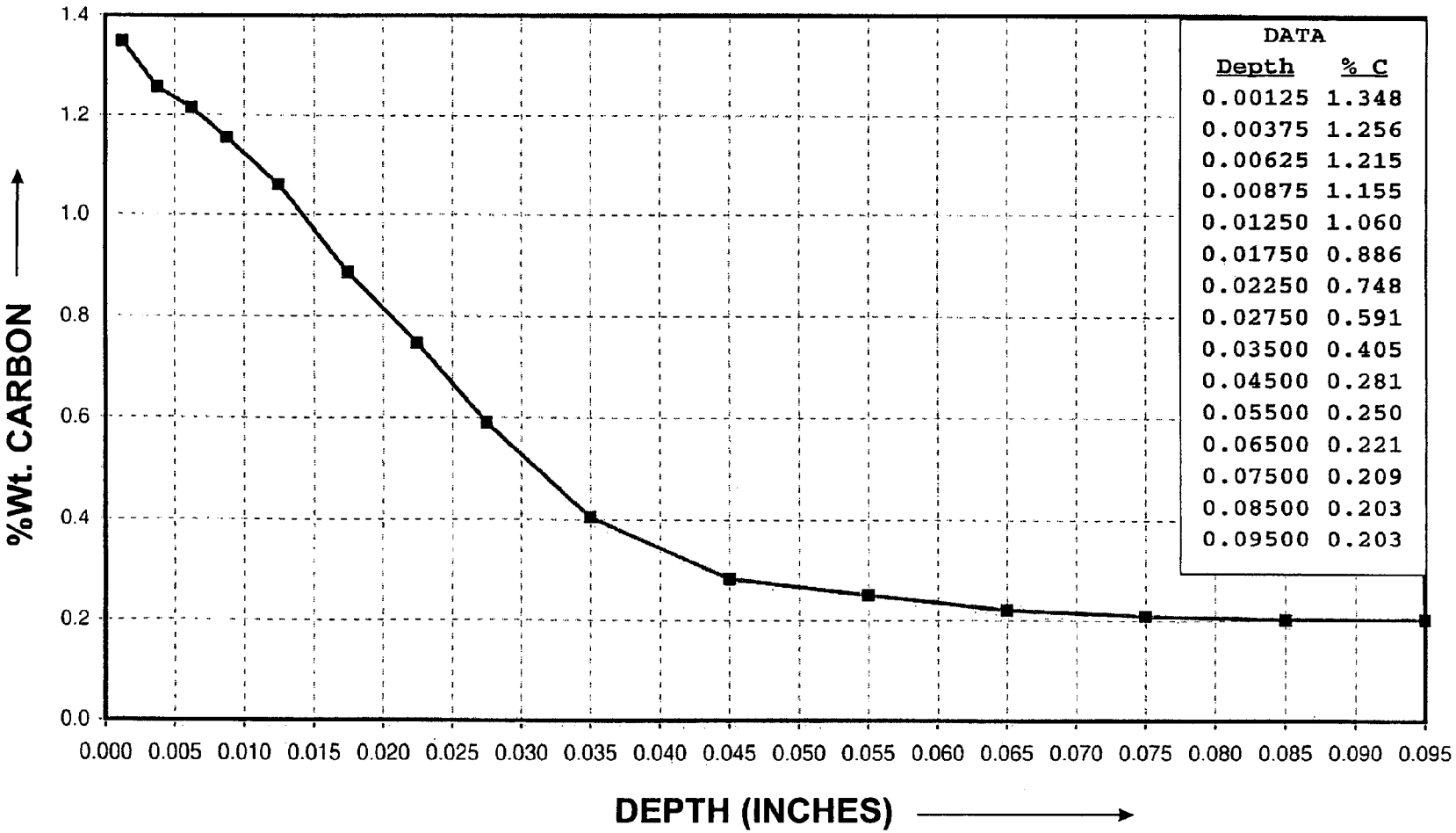
FIG. 11 is a hardness gradient graph of test bar specimen taken during the carburizing test depicted in FIG. 9; and, FIGS. 12 and 13 are hardness gradients of test bar specimens using different unsaturated aromatics than that shown in FIG. 11.
Figure 12:
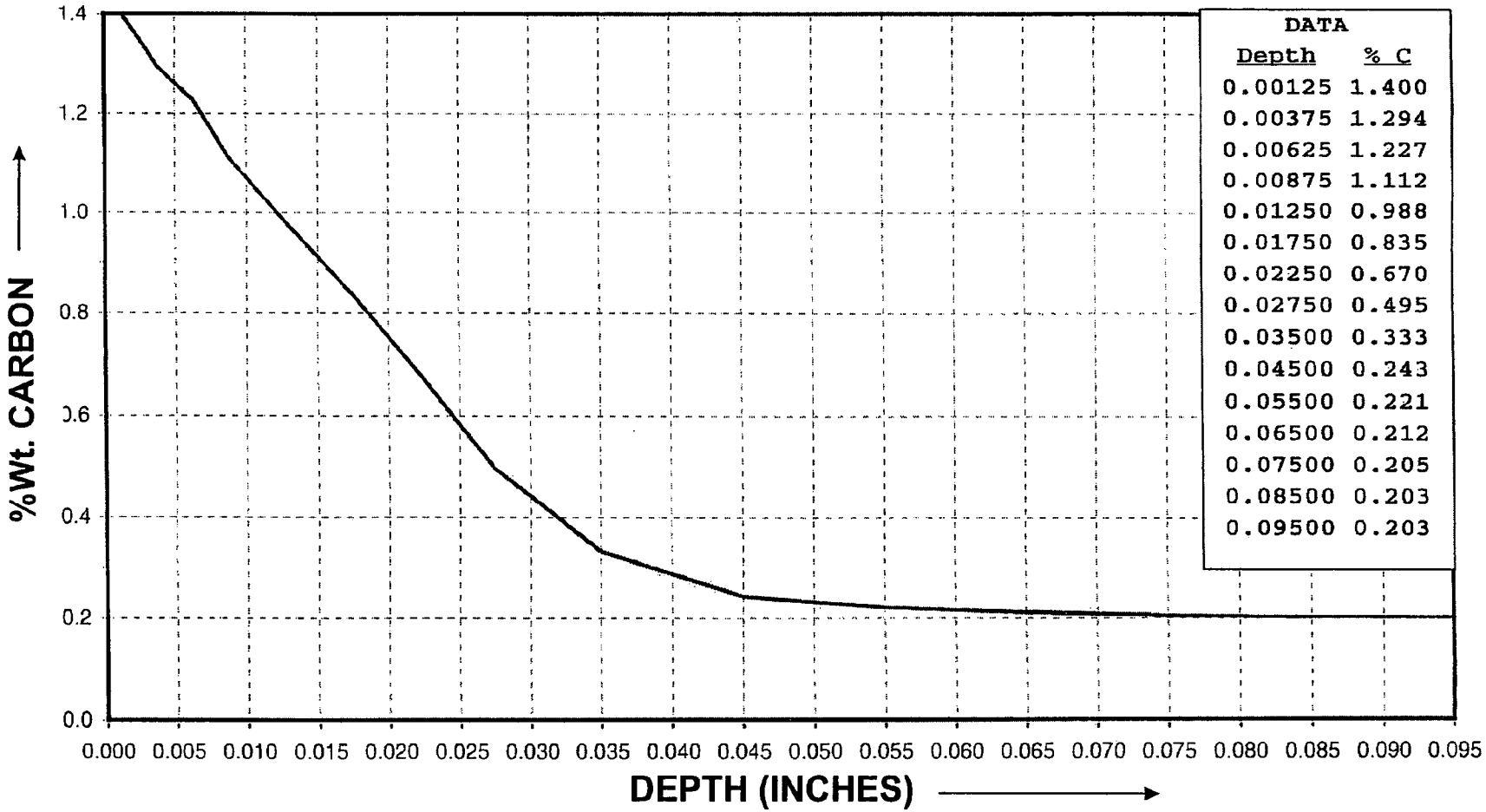
Figure 13:
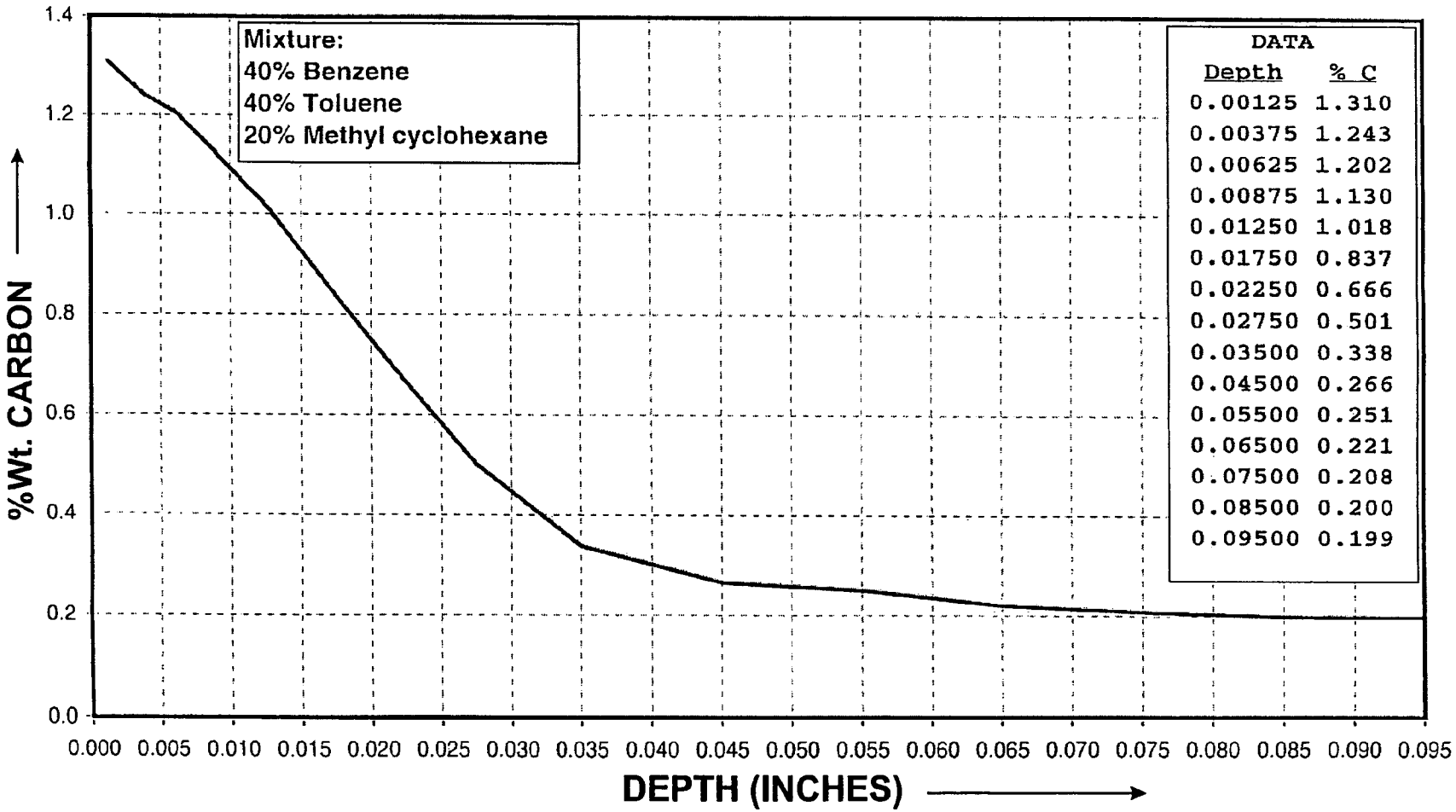

There are a number of carburizing results which have been conducted with benzene, toluene and m-xylene that could be included in this description of the invention. However, the graph shown in FIG. 9 was obtained on a 5130 transmission helical gear having a 1 {fraction (7/16)}" O.D. (outside diameter) and a {fraction (11/16)}" I.D. (inside diameter) and a height of about ¾". Gears of this type are considered to have a complex or convoluted geometry and it is especially difficult to obtain uniform carburizing results at the pitch and root diameters of the gear. FIG. 9 plots the hardness and case depth for the carburized gear at its pitch diameter indicated by the trace passing through triangles designated by reference numeral 160 and at its root diameter by the trace passing through squares designated by reference numeral 161. Variation and hardness between pitch and root diameter is close. This test however was not run to obtain hardness variations on the gear but to determine if carbon at deep depths of 0.040" to 0.050" could be obtained on sample bars which were being tested. Attached as FIG. 11 is a graph showing the carbon gradient vs. case depth for the test bars (which were carburized with the gear tested in FIG. 9) and shows a smooth transition down to the effective and finally the total case. As a basis for reference 8620 test specimens were also carburized for benzene and the hardness gradient test profile for a typical bar specimen is shown in FIG. 12. In this test, 1.25 l/m of benzene and 8.0 l/m of hydrogen were flowed through the hydrogenation coil into the furnace at 1750° F. carburizing temperature. FIG. 13 shows the hardness gradient for the same test conditions (same flow rates, and temperature) but for a mixture of 40% benzene, 40% toluene, and 20% methylcyclohexane. The graphs are very similar. Under the same test conditions, hardness gradients for toluene and m-xylene generated traces which are not shown could almost be superimposed over the plots of FIGS. 12 and 13. In all hardness gradient graphs, surface carbon is at or close to saturation. The point at which 0.40% carbon occurs is the same for all plots which states the effective depth. The point at which base metal plus 0.25% or 0.35% carbon occurs is the same which is total case depth. The curves are all fairly smooth which indicates the gas carburizing atmosphere was constant throughout the test.

Thus in the gear cycle described below and in contrast to the cyclohexane hardness test results shown in the related patent application, the carburizing temperature for the gear shown in FIG. 9 was higher (1750° F. compared to 1700° F.), carburizing time was longer (two hours compared to 55 minutes) and there was no diffuse cycle (through carburization of the tooth would have occurred at that time). Thus comparison between the curve shown in the related application and that shown in FIG. 9 can not be had. Still the graphs are similar. The root to pitch ratio (effective case—where RC is 50—for root is 0.038" and effective case for pitch is roughly 0.041") is about 92.6% which is similar to what was observed for the cyclohexane tests and is very good for vacuum carburizing.

The carburizing tests were conducted in assignee's hot wall vacuum furnace such as shown in FIG. 8. This vacuum furnace, however, had only one fuel injector 125 running. The work tray was loaded with 8620 test bars to provide a surface area load and the gear "added". The duty cycle for the fuel injector was fixed. That is, the injector was pulsed on and off at the same frequency throughout the cycle. The flow was not reversed nor was the timing of the firing changed. Thus, no attempt was made to provide improved gas flow about the work so that the improved results can be attributed only to the carburizing gas.

The furnace chamber with the work was heated to 1750° F. under hard vacuum and allowed to soak at 1750° F. for about 2 hours. The carburizing cycle was started using toluene at 9.5 torr and lasted for about 2 hours. The flow rate (vapor flow rate) of toluene was 2.65 liters/minute. (Injector pulse was 70 milliseconds with 11 psig blanked pressure.) Hydrogen at a rate of 4.0 l/m was flowed with the pulsed toluene through hydrogenation coil. After 2 hours, the EVAC valve was opened and the choker valve was closed so that the vacuum pump was allowed to remove all furnace atmosphere.

There was no diffuse cycle.

Because the vacuum furnace did not have a liquid quench or high pressure gas quench, parts were sent to a commercial heat treater who case hardened the parts with a Surface Combustion multi-chamber vacuum furnace having an oil quench. The parts were heated to austenitic temperature of 1550° F. and allowed to soak at this temperature for as short a time as possible, i.e., 55 minutes. Some diffusion can occur at this temperature but it is believed negligible. The parts were then oil quenched in a vacuum followed by a deep freeze and tempered for one hour at 350° F. The parts were then cut, polished and microhardness readings taken, as is conventional to produce the graphs depicted in FIG. 9.

The invention has been explained with reference to vacuum carburizing per se. Experiments have not been undertaken with respect to carbonitriding. It is believed that the invention will work as described with the addition of ammonia which will serve as a source of hydrogen as well as providing monatomic nitrogen. However, within the hydrocarbon field are ring hydrocarbons which contain monatomic nitrogen. These hydrocarbons are classified within the definition of aromatics and can be a source for not only providing the carbon for carburizing as in the case of the cyclohexane preferred embodiment but also for providing monatomic nitrogen for carbonitriding. However, as of the date of this patent, tests have not been undertaken and specific cyclic hydrocarbons have not been selected for investigation.

Within the field of carbonitriding using ammonia, typically ammonia is used at temperatures in the range of 900° F. to 1100° F. for the process described as ferritic nitrocarburizing and at higher temperatures in the range of 1525° F. to 1640° F. described as carbonitriding. Both of the aforementioned processes typically use ammonia as the source of nitrogen.

Within the scope of this invention, it is possible to supply a cyclic hydrocarbon for the purpose of supplying both activated carbon and monatomic nitrogen simultaneously from one hydrocarbon compound. There are cyclic compounds available with at least one carbon in the ring replaced by one "N" in monatomic form. This compound at such time as ring rupture, fracture or cracking would release carbon for the purpose of placing carbon in solution with the iron and would likewise release monatomic nitrogen for placing nitrogen in solution with the iron at the same time. In accordance with this invention, the hydrocarbon would be hydrogenated. Depending on temperature the nitrogen or nitrogen compound may split off the hydrocarbon during hydrogenation. The process could be viewed as a two step process. Reformation of the hydrocarbon into nitrogen and carburizing hydrocarbons occurs first and then carburizing and nitriding by both gases in the furnace proper occurs second with hydrogen addition used to control the carburizing reaction (abundance of carbon would be present) to achieve the desired ratio of nitriding to carburizing.

In addition or alternately, there are cyclic hydrocarbons that have NH and $NH_2$ components attached to any of the carbons in the ring. Many of these commercially available compounds have more than one NH or $NH_2$ group and may have these groups with or without the methyl or ethyl groups. It is also possible to select from the group that have $NHCH_3$ groups attached. It is therefore possible to supply by choice of compounds different carbon to nitrogen ratios in the case altering gas. For example, cyclic hydrocarbons such as aniline or methylpiperidine or piperidine, or speridine are some hydrocarbons that may be suitable. There are also saturated hydrocarbons such as cyclohexylamine also called aminocyclohexane or cyclohexanamine which have suitable boiling and freeze points that are available in liquid form and technically would be suitable to operate with liquid injection systems described herein.

It is also recognized that many of these compounds are considered environmentally unfriendly. However, it is believed that upon contact with the iron workpiece, the hydrocarbon will likewise decompose by catalytic reaction (as with the carburizing hydrocarbons of the present invention) on the steel workpiece and leave the furnace as methane or $N_2$. Experimentation is required to prove out the theory suggested, but when compared to traditional atmosphere carbonitriding where traditional furnaces are typically leaking gases to the environment and work place, it is foreseen that vacuum technology keeps these types of compounds safely away from both workers and the environment. Should it be determined that some small percentages of such compounds remain, provisions could be added to either catalytically destruct such materials or oxidize such materials outside the furnace vacuum chamber.

The invention has been described with reference to preferred and alternative embodiments. Obviously, alterations and modifications will occur to those skilled in the art upon reading and understanding the detailed description of the invention set forth above. As mentioned above, the unsaturated aromatic carburizing medium can be formulated as a blend of unsaturated aromatics and a naphthenes carburizing medium will be injected into the furnace chamber proper and work in a perfectly acceptable manner. It should be clear to those skilled in the art that the invention will work if conventional carburizing gases, say in liquid form, are blended or mixed with the unsaturated aromatic hydrocarbons and the mixture metered into the furnace. The added conventional carburizing gases will then carburize as is conventionally known and the unsaturated aromatics disclosed herein will hydrogenate to a preferred naphthenes and carburize as disclosed herein. Of course, to realize the advantages of the invention, the "blend" would contain the unsaturated aromatic as a major component thereof, for example, 50% or more of the blend would be formulated to produce naphthenes hydrocarbons. It is intended to include all such alterations and modifications insofar as they come within the scope of the present invention.

What is claimed is:

1. A vacuum furnace for carburizing ferrous workpieces therein comprising:

a furnace casing defining a furnace chamber proper therein;

a heater within the furnace chamber;

a vacuum pump in fluid communication with the furnace chamber;

at least one injector of the pulse operating type, the injector having an inlet in fluid communication with a source of liquid carburizing hydrocarbon under pressure and an outlet;

a hydrogenation coil having an inlet in fluid communication with the injector outlet and an outlet in fluid communication with the furnace chamber;

a hydrogen supply device configured to supply a set quantity of hydrogen to the hydrogenation coil; and, a controller for controlling: i) the heater for regulating the temperature of the workpiece in the furnace chamber, ii) the vacuum pump valve for regulating the pressure of the furnace chamber, iii) the injector for regulating the pulsing of the injector; and, iv) the hydrogen supply device for regulating the quantity of hydrogen gas supplied to the hydrogenation coil.

2. The furnace of claim 1, further including a plurality of the injectors circumferentially spaced about the furnace casing with each injector having a hydrogenation coil associated therewith.

3. The furnace of claim 2, wherein the furnace casing has an opening with a sealed duct extending therefrom, the duct having insulation over at least a portion thereof and the hydrogenation coil mounted in the duct.

4. The furnace of claim 3, wherein the furnace is a hot wall furnace having a single casing and insulation supplied thereto, the opening extending through the insulation and defining the duct for mounting the hydrogenation coil.

5. A vacuum carburizing furnace for ferrous workpiece(s) comprising:

a furnace pressure chamber configured to be maintained at a vacuum while a carburizing gas within the furnace chamber disassociates to produce carbon absorbed into a surface of the workpiece to produce carbon in solution and $Fe_3C$;

a supply of unsaturated aromatic hydrocarbon and a supply of hydrogen;

a metering device configured to meter a set quantity of the unsaturated aromatic hydrocarbon with a set quantity of the hydrogen to hydrogenate a substantial portion of the unsaturated aromatic hydrocarbon into a naphthene hydrocarbon; and, a delivery device configured to add the naphthene hydrocarbon into the furnace chamber as the carburizing gas along with any hydrogen not used in the hydrogenation reaction.

6. The furnace of claim 5, wherein the set quantity of the hydrogen gas is at least three times that of the unsaturated aromatic hydrocarbon.

7. The furnace of claim 5, wherein the delivery device includes a mixing chamber in fluid communication with, and at the same pressure as the furnace chamber and configured to meter the hydrogen and the unsaturated aromatic hydrocarbon into the mixing chamber while maintaining the temperature of the mixing chamber at about 700° F. to 1200° F.

8. The furnace of claim 1, further including a supply of unsaturated aromatic hydrocarbon comprising any one or a blend of any one or more of the following: a) benzene hydrogenated to cyclohexane; b) toluene to methylcyclohexane; c) xylene to dimethylcyclohexane; d) ethylbenzene to ethylcyclohexane; e) isopropylbenzene to isopropylcyclohexane; f) napthalene to tetrahydronaphthalene and/or decahydronaphthalene; and/or, g) methylnaphthalene to methyltetrahydronaphthalene and/or methyldecahydronaphthalene.

9. A vacuum carburizing furnace for ferrous workpiece(s) comprising:

a furnace pressure chamber configured to be maintained at a vacuum while a carburizing gas within the furnace chamber disassociates to produce carbon absorbed into a surface of the workpiece to produce carbon in solution and $Fe_3C$;

a metering device configured to meter a set quantity of unsaturated aromatic hydrocarbon with a set quantity of hydrogen to hydrogenate a substantial portion of the unsaturated aromatic hydrocarbon into a naphthene hydrocarbon; and, a delivery device configured to add the naphthene hydrocarbon into the furnace chamber as the carburizing gas along with any hydrogen not used in the hydrogenation reaction;

wherein the delivery device includes a mixing chamber in fluid communication with, and at the same pressure as the furnace chamber and configured to meter the hydrogen and the unsaturated aromatic hydrocarbon into the mixing chamber while maintaining the temperature of the mixing chamber at about 700° F. to 1200° F.;

wherein the mixing chamber includes a hydrogenation coil having a set number of turns within a controlled enclosure, whereby a residence time of the hydrogen and the unsaturated aromatic hydrocarbon is established within the enclosure, whereby the hydrogenation of the unsaturated aromatic hydrocarbon tends to occur.

10. The furnace of claim 9, wherein the controlled enclosure has a temperature differential varying from a minimum at its entrance to a maximum at its exit, the hydrogenation coil longitudinally extending the length of the controlled enclosure from a temperature differential inlet to a temperature differential outlet, and wherein the hydrogenation coil is configured to allow the hydrogen and the unsaturated aromatic hydrocarbon to travel in the coil from the temperature differential inlet to the temperature differential outlet.

11. The furnace of claim 10, wherein the hydrogenation coil includes a coil extension configured to receive the hydrogen and unsaturated aromatic hydrocarbon, the coil extension longitudinally extending the length of the controlled enclosure;

the coil extension being configured to:

i) allow the hydrogen and the unsaturated aromatic hydrocarbon to travel through the coil extension to the temperature differential outlet of the controlled enclosure;

ii) travel in the hydrogenation coil from the temperature differential outlet to the temperature differential inlet; and then, iii) travel from the temperature differential inlet to the temperature differential outlet and into the furnace chamber.

12. The furnace of claim 10, wherein the hydrogenation coil is configured to allow the unsaturated aromatic hydrocarbon to travel: i) through the hydrogenation coil to the temperature differential outlet whereby the unsaturated aromatic hydrocarbon is heated; and then, ii) through the hydrogenation coil to the temperature differential inlet, wherein the hydrogenation coil is configured to allow the heated unsaturated aromatic hydrocarbon to come into contact with the hydrogen, and to allow the combined hydrogen and heated unsaturated aromatic hydrocarbon to travel from the temperature differential inlet to the temperature differential outlet.

13. The furnace of claim 1, wherein the hydrogenation coil includes a catalyst for reducing the reaction time of the hydrogen step.

14. The furnace of claim 13, wherein the hydrogenation coil is stainless steel and the catalyst includes iron present in the stainless steel.

15. A vacuum carburizing furnace for ferrous workpiece(s) comprising:

a furnace pressure chamber configured to be maintained at a vacuum while a carburizing gas within the furnace chamber disassociates to produce carbon absorbed into a surface of the workpiece to produce carbon in solution and $Fe_3C$;

a metering device configured to meter a set quantity of unsaturated aromatic hydrocarbon with a set quantity of hydrogen to hydrogenate a substantial portion of the unsaturated aromatic hydrocarbon into a naphthene hydrocarbon: and, a delivery device configured to add the naphthene hydrocarbon into the furnace chamber as the carburizing gas along with any hydrogen not used in the hydrogenation reaction;

wherein the set quantity of the hydrogen gas is at least three times that of the unsaturated aromatic hydrocarbon, and further including a device for providing the unsaturated aromatic hydrocarbon as a liquid, and at least one injector having: i) an inlet in contact with the liquid unsaturated aromatic hydrocarbon, and ii) an outlet in contact with a hydrogenation coil;

the injector being configured to pulse the unsaturated aromatic hydrocarbon as a liquid into the hydrogenation coil, whereby the unsaturated aromatic liquid hydrocarbon vaporizes as a gas upstream of, or within, the hydrogenation coil.

16. The furnace of claim 15, further including an expansion chamber adjacent to the injector outlet, whereby the unsaturated aromatic hydrocarbon is vaporized in the expansion chamber upstream of the hydrogenation coil.

17. The furnace of claim 15, wherein the injector is configured to provide a fixed or varied frequency or pulse width during the carburizing of the workpiece.

18. The furnace of claim 15, further including a plurality of injectors circumferentially spaced about the furnace chamber and the firing order of the injectors is fixed or variable.

19. The furnace of claim 15, wherein the injector is configured to deliver pulses until a set volume of the unsaturated aromatic hydrocarbon has been injected into the hydrogenation coil to produce a set quantity of naphthene hydrocarbons in the furnace chamber.

20. The furnace of claim 5, including a hydrogen metering device configured to deliver hydrogen gas at a flow rate relative to the flow rate of the unsaturated aromatic hydrocarbon to produce quantities of hydrogen in the furnace chamber sufficient to prevent saturation of carbon into the iron at the surface of the workpiece.

21. The furnace of claim 20, further including a methane concentration measuring device in the furnace chamber.

22. A vacuum carburizing furnace for ferrous workpiece(s) comprising:

a furnace pressure chamber configured to be maintained at a vacuum while a carburizing gas within the furnace chamber disassociates to produce carbon absorbed into a surface of the workpiece to produce carbon in solution and $Fe_3C$;

a metering device configured to meter a set quantity of unsaturated aromatic hydrocarbon with a set quantity of hydrogen to hydrogenate a substantial portion of the unsaturated aromatic hydrocarbon into a naphthene hydrocarbon; and, a delivery device configured to add the naphthene hydrocarbon into the furnace chamber as the carburizing gas along with any hydrogen not used in the hydrogenation reaction;

wherein the delivery device includes a mixing chamber in fluid communication with, and at the same pressure as the furnace chamber and configured to meter the hydrogen and the unsaturated aromatic hydrocarbon into the mixing chamber while maintaining the temperature of the mixing chamber at about 700° F. to 1200° F.; and, wherein the mixing chamber comprises a honeycomb matrix.

23. A vacuum carburizing furnace for ferrous workpiece(s) comprising:

a furnace pressure chamber configured to be maintained at a vacuum while a carburizing gas within the furnace chamber disassociates to produce carbon absorbed into a surface of the workpiece to produce carbon in solution and $Fe_3C$;

a metering device configured to meter a set quantity of unsaturated aromatic hydrocarbon with a set quantity of hydrogen to hydrogenate a substantial portion of the unsaturated aromatic hydrocarbon into a naphthene hydrocarbon; and, a delivery device configured to add the naphthene hydrocarbon into the furnace chamber as the carburizing gas along with any hydrogen not used in the hydrogenation reaction;

wherein the delivery device includes a mixing chamber in fluid communication with, and at the same pressure as the furnace chamber and configured to meter the hydrogen and the unsaturated aromatic hydrocarbon into the mixing chamber while maintaining the temperature of the mixing chamber at about 700° F. to 1200° F.; and, wherein the mixing chamber comprises a gas permeable matrix.

24. A vacuum carburizing furnace for ferrous workpiece(s) comprising:

a furnace pressure chamber configured to be maintained at a vacuum while a carburizing gas within the furnace chamber disassociates to produce carbon absorbed into a surface of the workpiece to produce carbon in solution and $Fe_3C$;

a metering device configured to meter a set quantity of unsaturated aromatic hydrocarbon with a set quantity of hydrogen to hydrogenate a substantial portion of the unsaturated aromatic hydrocarbon into a naphthene hydrocarbon; and, a delivery device configured to add the naphthene hydrocarbon into the furnace chamber as the carburizing gas along with any hydrogen not used in the hydrogenation reaction;

wherein the delivery device comprises an injector configured to be mounted to an expansion chamber which, in turn, is configured to be mounted to the furnace.

25. The furnace of claim 22, wherein the expansion chamber is outside the furnace casing.

26. The furnace of claim 24, wherein the expansion chamber is configured to be mounted within the furnace.

27. The furnace of claim 15, wherein multiple injectors are positioned at a desired angle in a desired configuration and wherein deflecting radiation shields are mounted therein.

28. The furnace of claim 27, wherein the injectors are mounted with outlets above or below the workpiece within the furnace chamber.

29. The furnace of claim 15, wherein the shields are configured so that the radiation shields produce a parabolic deflection back to the workpiece.

* * * * *